US010056708B2

(12) United States Patent
Onuma et al.

(10) Patent No.: US 10,056,708 B2
(45) Date of Patent: Aug. 21, 2018

(54) CONTACT-CONNECTION STRUCTURE

(71) Applicant: YAZAKI CORPORATION, Tokyo (JP)

(72) Inventors: Masanori Onuma, Shizuoka (JP); Ryo Fujikawa, Shizuoka (JP); Takahiro Yudate, Shizuoka (JP); Yoshitaka Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/292,198

(22) Filed: Oct. 13, 2016

(65) Prior Publication Data

US 2017/0033487 A1 Feb. 2, 2017

Related U.S. Application Data

(63) Continuation of application No. PCT/JP2015/061692, filed on Apr. 16, 2015.

(30) Foreign Application Priority Data

Apr. 18, 2014 (JP) ..... 2014-086356
Apr. 23, 2014 (JP) ..... 2014-088842
(Continued)

(51) Int. Cl.
*H01R 13/11* (2006.01)
*H01R 4/26* (2006.01)
(Continued)

(52) U.S. Cl.
CPC ..... *H01R 13/11* (2013.01); *H01R 4/26* (2013.01); *H01R 13/05* (2013.01); *H01R 13/115* (2013.01)

(58) Field of Classification Search
CPC ..... H01R 13/11; H01R 13/111; H01R 13/113; H01R 13/187; H01R 43/16
(Continued)

(56) References Cited

U.S. PATENT DOCUMENTS 4,767,350 A * 8/1988 Cooper ..... H01R 12/716 439/271
4,874,338 A * 10/1989 Bakermans ..... H01R 13/114 439/842
(Continued)

FOREIGN PATENT DOCUMENTS

CN 102834981 A 12/2012
CN 103094748 A 5/2013
(Continued)

OTHER PUBLICATIONS

An Office Action dated Dec. 12, 2017 in counterpart Japanese patent application No. 2014-086356.
(Continued)

*Primary Examiner* — Hien Vu
(74) *Attorney, Agent, or Firm* — Metrolexis Law Group, PLLC

(57) ABSTRACT

A first contact part in which three or more first indent parts are projectingly provided on the same circumference and a second contact part in which one second indent part is projectingly provided, in a terminal insertion process, the first indent part of the first contact part slides on the second contact part and the second indent part of the second contact part slides on the first contact part, and at a terminal insertion completion position, the second indent part intrudes into a position surrounded by the three or more first indent parts and outer circumference surfaces of the first indent parts come into contact with outer circumference surfaces of the second indent part, respectively.

4 Claims, 28 Drawing Sheets

(30) Foreign Application Priority Data

| | | |
|---|---|---|
| Apr. 23, 2014 | (JP) | 2014-088844 |
| Apr. 24, 2014 | (JP) | 2014-090049 |
| Apr. 24, 2014 | (JP) | 2014-090166 |
| Apr. 25, 2014 | (JP) | 2014-091726 |

(51) Int. Cl.
*H01R 13/05* (2006.01)
*H01R 13/115* (2006.01)

(58) Field of Classification Search
USPC ..... 439/851, 852, 860
See application file for complete search history.

(56) References Cited

U.S. PATENT DOCUMENTS

| | | | | |
|---|---|---|---|---|
| 5,188,545 | A * | 2/1993 | Hass | H01R 13/11 439/851 |
| 5,620,347 | A * | 4/1997 | Sawada | H01R 13/111 439/851 |
| 5,857,879 | A * | 1/1999 | Endo | H01R 43/16 439/843 |
| 2013/0109250 | A1 | 5/2013 | Haga | |
| 2014/0322992 | A1 | 10/2014 | Nakamura et al. | |

FOREIGN PATENT DOCUMENTS

| | | | |
|---|---|---|---|
| JP | 3041482 | U | 9/1997 |
| JP | 2001-351712 | A | 12/2001 |
| JP | 2002-025674 | A | 1/2002 |
| JP | 2006-179209 | A | 7/2006 |
| JP | 2006-221927 | A | 8/2006 |
| JP | 2007-18803 | A | 1/2007 |
| JP | 2007-280825 | A | 10/2007 |
| JP | 2011-119100 | A | 6/2011 |
| JP | 2013-168279 | A | 8/2013 |
| JP | 2015-210947 | A | 11/2015 |
| WO | 2011/125727 | A1 | 10/2011 |
| WO | 2013/108874 | A1 | 7/2013 |
| WO | 2014/034418 | A1 | 3/2014 |
| WO | 2014/055227 | A1 | 4/2014 |

OTHER PUBLICATIONS

An Office Action dated Dec. 12, 2017 in counterpart Japanese patent application No. 2014-088842.
An Office Action dated Dec. 12, 2017 in counterpart Japanese patent application No. 2014-088844.
An Office Action dated Dec. 12, 2017 in counterpart Japanese patent application No. 2014-090049.
An Office Action dated Dec. 12, 2017 in counterpart Japanese patent application No. 2014-090166.
An Office Action dated Dec. 12, 2017 in counterpart Japanese patent application No. 2014-091726.
An office action dated Feb. 9, 2018 in a counterpart Chinese patent application.
The Japanese office action (Application No. 2014-090049) dated Feb. 20, 2018 in a counterpart Japanese Patent application.
The Japanese office action (Application No. 2014-090166) dated Feb. 20, 2018 in a counterpart Japanese Patent application.

* cited by examiner

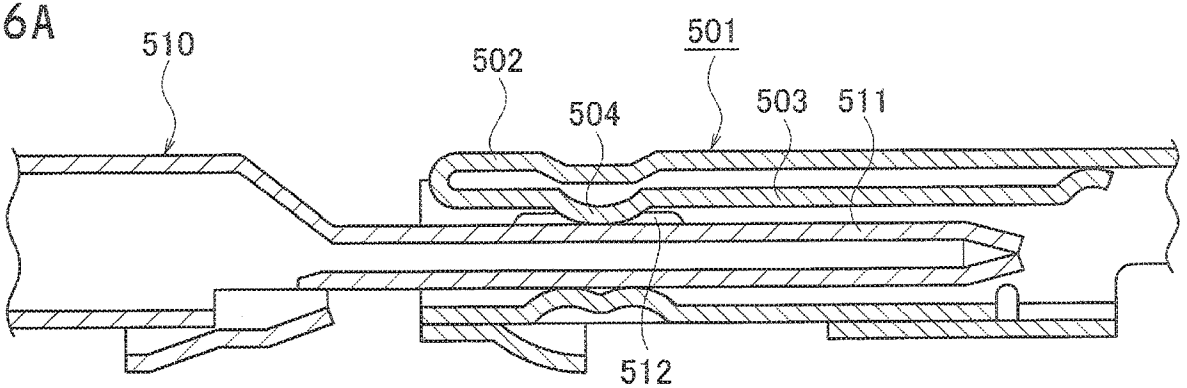
FIG. 26A
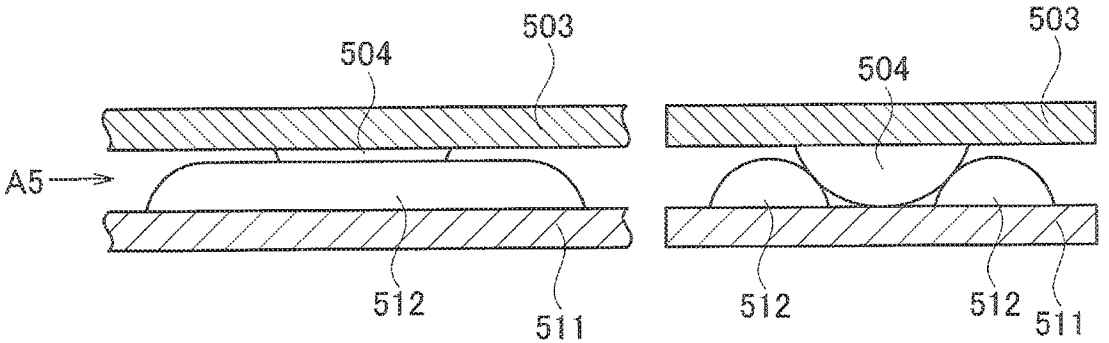
FIG. 26B
FIG. 26C
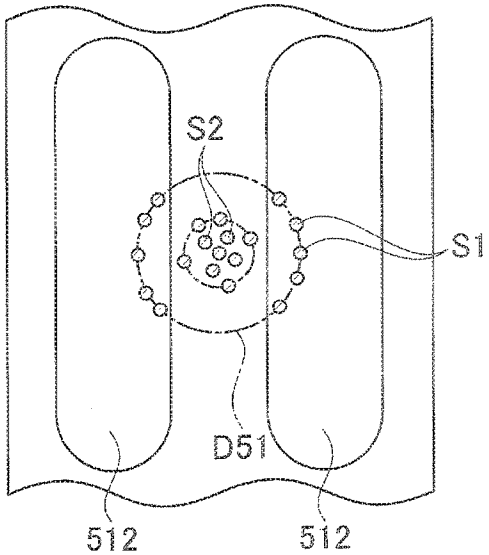
FIG. 26D

CONTACT-CONNECTION STRUCTURE

CROSS REFERENCE TO RELATED APPLICATIONS

This application is a Continuation of PCT Application No. PCT/JP2015/061692 filed on Apr. 16, 2015, and claims the priority based on Japanese Patent Application No. 2014-086356 filed on Apr. 18, 2014, Japanese Patent Application No. 2014-088842 filed on Apr. 23, 2014, Japanese Patent Application No. 2014-088844 filed on Apr. 23, 2014, Japanese Patent Application No. 2014-090049 filed on Apr. 24, 2014, Japanese Patent Application No. 2014-090166 filed on Apr. 24, 2014, Japanese Patent Application No. 2014-091726 filed on Apr. 25, 2014, the entire contents of these applications are herein incorporated into the specification by reference.

TECHNICAL FIELD

The present invention relates to a contact-connection structure that performs electric connection between a first terminal and a second terminal.

BACKGROUND ART

In FIG. 29 and FIG. 30, a male terminal and female terminal to which a conventional contact-connection structure has been applied are shown (see Patent Literature 1 as an analogous art).

As shown in FIG. 29, FIG. 30 and FIG. 31, a female terminal 1051 has a quadrilateral box part 1052, and an elastic deflection part 1053 that is provided integrally with this box part 1052 and is arranged in the box part 1052.

The elastic deflection part 1053 is provided with an indent part 1054 that projects toward the bottom surface side.

The indent part 1054 is almost spherical in shape of its outer circumference surface thereof and the central top is situated at the lowermost part.

Note that, although in FIG. 29 and FIG. 30, illustration is omitted, plating (for example, tin plating) is performed on the entire area of an outer surface of the female terminal 1051 and a plated layer is provided from the viewpoints of improvement of connection reliability under a high-temperature environment, improvement of corrosion resistance under a corrosive environment and so forth.

As shown in FIG. 29, FIG. 30 and FIG. 32, a male terminal 1060 has a tabular tab part 1061.

Note that, although in FIG. 29 and FIG. 30, illustration is omitted, plating (for example, tin plating) is performed on the entire area of an outer surface of the male terminal 1060 and a plated layer is provided from the viewpoints of improvement of the connection, reliability under the high-temperature environment, improvement of the corrosion resistance under the corrosive environment and so forth.

When plating (tin plating) is performed as described above, and then a reflow process is performed, a plated layer (a copper/tin alloy layer, a tin-plated layer) is formed on the outer surface side of a base material of a copper alloy material, and an oxide film is formed on an outer surface of the plated layer.

In the above-mentioned configuration, when the tab part 1061 of the male terminal 1060 is inserted into the box part 1052 of the female terminal 1051 at a position in FIG. 29, the elastic deflection part 1053 deflectively deforms and insertion of the tab part 1061 is allowed.

In an insertion process of the tab part 1061, the indent part 1054 of the elastic deflection part 1053 slides on a contact surface 1061*a* of the tab part 1061, and at a terminal insertion completion position, as shown in FIG. 30 and FIG. 33, the indent part 1054 of the elastic deflection part 1053 and the contact surface 1061*a* of the tab part 1061 come into contact with each other.

As described above, when the indent part 1054 slides on the contact surface 1061*a* of the tab part 1061, deflection restoring force of the elastic deflection part 1053 acts as a contact load and thereby, as shown in FIG. 35A, FIG. 35B (illustration of a plated layer, an oxide film formed on the indent part 1054 is omitted), an oxide film formed on the indent part 1054 is destroyed, and a plated layer 1063 formed on the tab part 1061 is pushed into it and thereby an oxide film 1064 is destroyed.

When each oxide film 1064 is destroyed in this way, metal (for example, tin) for plating spouts out of a crack in each oxide film 1064 and thereby the indent part 1054 of the female terminal 1051 and the contact surface 1061*a* of the tab part 1061 of the male terminal 1060 electrically come into contact with each other.

That is, the indent part 1054 of the female terminal 1051 and the contact surface of the tab part 1061 of the male terminal 1060 electrically come into contact with each other, using the deflection restoring force of the elastic deflection part 1053 as the contact load.

Them an electric current flows through a contact surface between the indent 1 part 1054 and the tab part 1061 and thereby the female terminal 1051 and the male terminal 1060 are conducted.

Note that the oxide film 1064 is very high in electric resistance in comparison with tin and copper. Accordingly, in order to reduce contact resistance, it is necessary to destroy the oxide film 1064 so as to form many plating-to-plating contact surfaces (ohmic contact points).

In a conventional contact-connection structure, the oxide film is destroyed by the contact load between the indent part and the contact surface of the tab part so as to obtain a contact between plated metals of the indent part and the tab part at a destroyed spot of the oxide film.

CITATION LIST

Patent Literature

Patent Literature 1: Japanese Patent Laid-Open Publication No. 2007-280825

SUMMARY OF INVENTION

Technical Problem

However, in the conventional example, the indent part 1054 of the female terminal 1051 is almost spherical in shape and it comes into contact with the tab part 1061 of the male terminal 1060 at its top spot. Accordingly, as shown in FIG. 34, since an outer diameter of this single contact surface becomes an apparent contact surface diameter D02 (a diameter), the apparent contact surface diameter D02 (indicated by hatching for clarification in FIG. 34) is small.

In addition, since an apparent contact surface E02 does not actually conic into contact with it over the entire region due to influence of surface roughness and so forth, the entire region does not bear electric conduction and a surface (a true contact surface) that actually comes into contact with it bears the electric conduction in the apparent contact surface E02. Here, although when the true contact surface is situated on an outer circumference part of the apparent contact surface diameter D02, the electric current is easy to flow, the true contact surface is yielded in the apparent contact surface E02 without regularity (randomly) in the conventional example. In the conventional example, since the apparent contact surface diameter D02 is small, and the true contact surface is yielded without having the regularity (randomly) in the apparent contact surface E02 in this way, there was such a problem that the contact resistance is large.

Here, although it is conceived to make the deflection restoring force (the contact load) of the elastic deflection part large and to upsize a contact part (an indent part 54) in order to reduce contact resistance by making the apparent contact surface diameter large, the female terminal 1051 and the male terminal 1060 are upsized and complicated.

In addition, in the above-mentioned conventional example, as shown in FIG. 35B, although it is conceived to make a contact pressure between contact parts large in order to promote destruction of the oxide film 1064 by increasing a pushing-in amount of the plated layer 1063 when the female terminal 1051 and the male terminal 1060 are to be brought into contact with each other at the terminal insertion completion position, since the plated layer 1063 is thin and the pushing-in amount of the plated layer 1063 is little, there is such a problem that the female terminal 1051 and the male terminal 1060 are upsized and complicated.

Accordingly, the present invention has been made in order to solve the above-mentioned problems and aims to provide a contact-connection structure that can reduce the contact resistance without upsizing and complicating the terminals to the utmost.

Solution to Problem

The present invention is a contact-connection structure having a first contact part in which three or more first indent parts are projectingly provided on the same circumference, and a second contact part in which one second indent part is projectingly provided, wherein in a terminal insertion process, the first indent part of the first contact part slides on the second contact part and the second indent part of the second contact part slides on the first contact part, and at a terminal insertion completion position, the second indent part intrudes into a position surrounded by the three or more first indent parts, and outer circumference surfaces of the first indent parts come into contact with outer circumference surfaces of the second indent part, respectively.

Each first indent part includes the one that is arranged at a position deviated from a sliding track of the second indent part.

BRIEF DESCRIPTION OF DRAWINGS

FIG. 26A shows the seventh embodiment as a reference technique, and is a sectional diagram of the female terminal and the male terminal in a connected state of the terminals.

FIG. 26B shows the seventh embodiment as a reference technique, and is an essential part side view of a contact point contact spot.

FIG. 26C shows the seventh embodiment as a reference technique, and is an A5 arrow diagram of FIG. 26B.

FIG. 26D shows the seventh embodiment as a reference technique, and is a diagram showing an apparent contact surface and a true contact surface.

DESCRIPTION OF EMBODIMENTS

Figure 1:
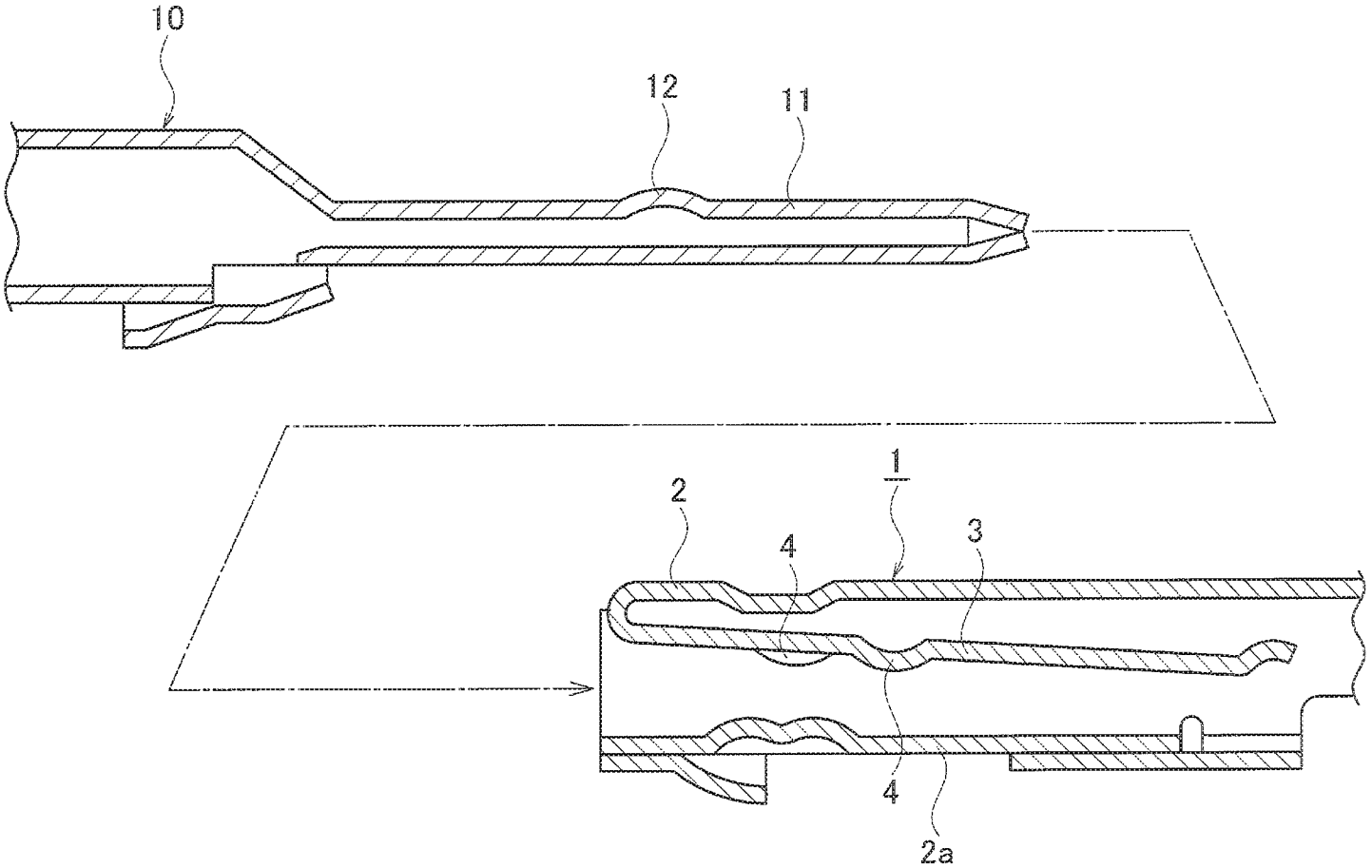
FIG. 1 shows a first embodiment of the present invention, and is a sectional diagram of a female terminal and a male terminal before terminal connection.

In the following, a rust embodiment of the present invention will be described on the basis of the drawings.

FIG. 1 to FIG. 4 show the first embodiment of the present invention. A contact-connection structure according to the present invention is applied between a female terminal that is a first terminal and a male terminal that is a second terminal. In the following, description will be made.

A female terminal 1 is arranged in a terminal housing chamber in a female side connector housing (not shown). The female terminal 1 is formed by folding a conductive metal (for example, a copper alloy) that has been punched into a desired shape. A tin-plated layer (not shown) is formed on an outer surface of the female terminal 1 from the viewpoints of improvement of connection reliability under a high-temperature environment, improvement of corrosion resistance under a corrosive environment and so forth. The female terminal 1 has a square box part 2 that opens at a front part into which a male terminal 10 is to be inserted, and an elastic deflection part 3 that is extended from an upper surface part of this box part 2 and is arranged in the box part 2. The elastic deflection part 3 is provided with three first indent parts 4 that project toward the bottom surface side.

Figure 2A:
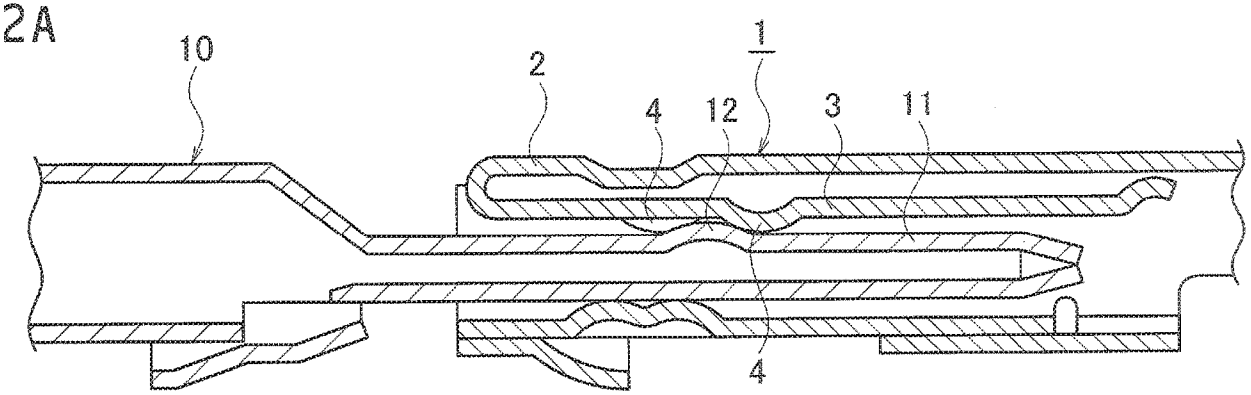
FIG. 2A shows the first embodiment of the present invention, and is a sectional diagram of the female terminal and the male terminal in a connected state of the terminals.
Figure 2B:
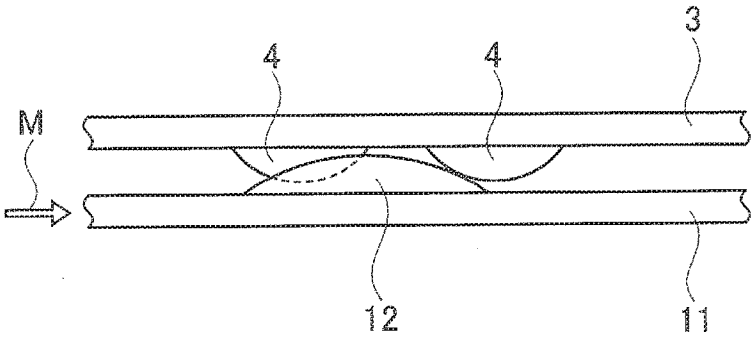
FIG. 2B shows the first embodiment of the present invention, and is an essential part side view of a contact connection spot.
Figure 2C:
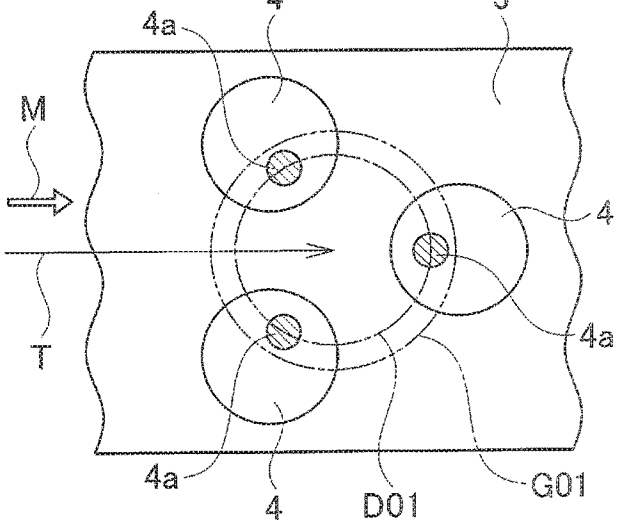
FIG. 2C shows the first embodiment of the present invention, and is a diagram showing an apparent contact surface diameter.
Figure 3A:
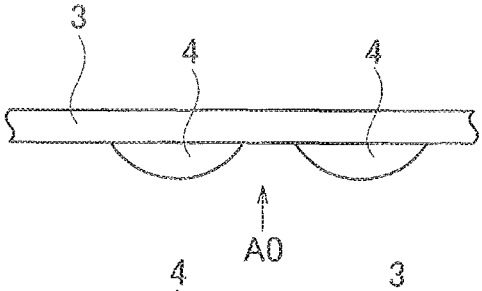
FIG. 3A shows the first embodiment of the present invention, and is an essential part side view of a contact part of the female terminal.
Figure 3B:
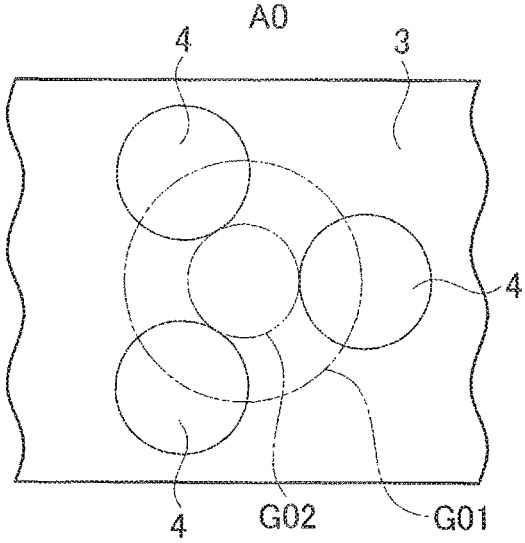
FIG. 3B shows the first embodiment of the present invention, and is an A0 arrow view of FIG. 3A.
Figure 4A:
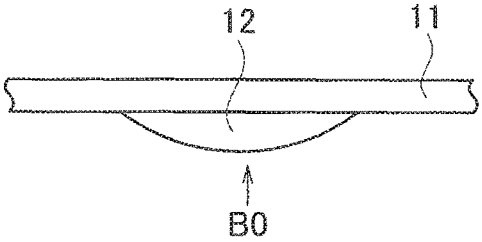
FIG. 4A shows the first embodiment of the present invention, and is an essential part side view of a contact part of the male terminal.
Figure 4B:
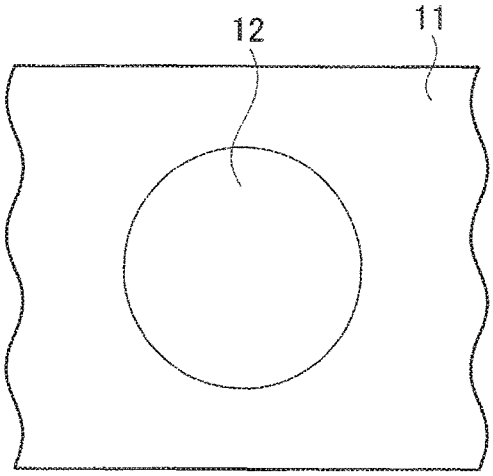
FIG. 4B shows the first embodiment of the present invention, and is a B0 arrow view of FIG. 4A.
Figure 5:
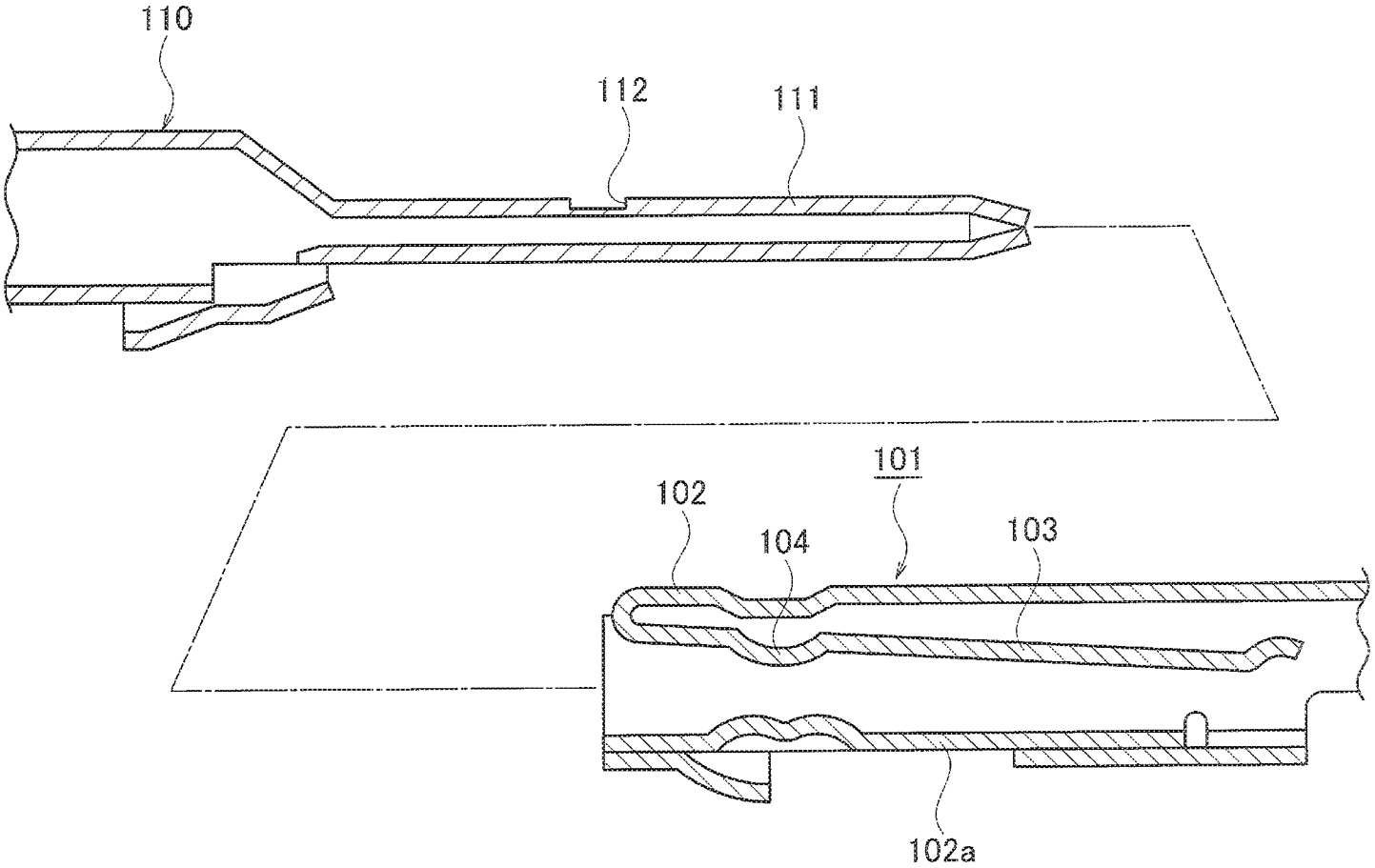
FIG. 5 shows a second embodiment as a reference technique, and is a sectional diagram of a female terminal and a male terminal before terminal connection.

The three first indent parts 4 are arranged at positions on the same circumference (G01) and at equal intervals (see FIG. 2C). Two of the three first indent parts 4 are arranged at upstream positions of an insertion direction M (shown in FIG. 2B) and one is arranged at a downstream position. The two upstream side first indent parts 4 are arranged at left and right symmetric positions of a sliding track T of a second indent part 12. The one downstream side first indent part 4 is arranged, though downstream of an insertion completion position of the second indent part 12, on an extension line of the sliding track T of the second indent part 12. Two of the three first indent parts 4 may be arranged at the positions deviated from the sliding track T (shown in FIG. 2C) of the second indent part 12 in this way. That is, the first indent parts 4 are arranged at positions where they can slide without running on the second indent part 12 to the utmost in a terminal insertion process or a terminal detachment process. Each first indent part 4 is almost spherical in shape of its outer circumference surface and the central top is situated at the lowermost part. The first indent part 4 can shift upward by deflective deformation of the elastic deflection part 3. In the female terminal 1, the elastic deflection part 3 and a bottom surface part 2*a* of the box part 2 form a first contact part.

The male terminal 10 is arranged in a terminal housing chamber in a male side connector housing (not shown). The male terminal 10 is formed by folding a conductive metal (for example, a copper alloy) that has been punched into a desired shape. A tin-plated layer (not shown) is formed on an outer surface of the male terminal 10 from the viewpoints of improvement of the connection reliability under the high-temperature environment, improvement of the corrosion resistance under the corrosive environment and so forth. The male terminal 10 has a tabular tab part 11. One second indent part 12 that projects upward is provided on an upper surface of the tab part 11. The second indent part 12 is arranged at a position where it intrudes into a position surrounded by the three first indent parts 4 at an insertion completion position (a position in FIG. 2A) with the female terminal 1 (see FIG. 2B). An outer diameter of the second indent part 12 is larger than a diameter of a circumference G02 (see FIG. 3B) with which inner edge ends of the three first indent parts 4 come into contact, and is set to a size that an outer circumference surface of the second indent part 12 comes into contact with each of outer circumference surfaces of the respective first indent parts 4 at the insertion completion position (the position in FIG. 2A) with the female terminal 1. In the male terminal 10, the tab part 11 forms a second contact part.

In the above-mentioned configuration, when fitting is made between the female side connector housing (not shown) and the male side connector housing (not shown), the tab part 11 of the male terminal 10 is inserted into the box part 2 of the female terminal 1 in a fitting process thereof. Then, first, a leading end of the tab part 11 abuts on the elastic deflection part 3, when insertion further advances from this abutment spot, the elastic deflection part 3 deflectively deforms and insertion of the tab part 11 is allowed. In an insertion process (the terminal insertion process) of the tab part 11, each first indent part 4 of the elastic deflection part 3 slides on a contact surface of the tab part 11. In addition, the second indent part 12 of the tab part 11 slides on a contact surface of the elastic deflection part 3. At the insertion completion position a connector fitting completion position), as shown in FIG. 2A to FIG. 2C, the three first indent parts 4 and the one second indent part 12 come into contact with one another using deflection restoring force of the elastic deflection part 3 as a contact load. When describing in detail, an outer circumference surface of each first indent part 4 comes into contact with an outer circumference surface of the second indent parts 12 and thus a true contact surface is yielded in this contact surface 4*a*. The contact surface 4*a* is clarified by being indicated by hatching in FIG. 2C.

In this contact-connection structure, at the insertion completion position, the second indent part 12 intrudes into the position surrounded by the three first indent parts 4, and the outer circumference surface of each first indent part 4 comes into contact with the outer circumference surface of the second indent part 12. Accordingly, a diameter on the circumference that passes the three contact surfaces 4*a* can be regarded as an apparent contact surface diameter D01 (shown in FIG. 2C) and therefore the apparent contact surface diameter D01 is large in comparison with that of a conventional example and the true contact surface is yielded on an outer circumference part of the apparent contact surface diameter D01. The electric current that flows through the contact part does not averagely flow relative to the apparent contact surface diameter D01 and is easy to flow to the outer circumference part of the contact surface diameter D01, and therefore it flows efficiently. From the above, the contact resistance can be reduced without upsizing and complicating to the utmost the female terminal 1 and the male terminal 10.

Next, that the contact resistance becomes small will be described by a Holm's contact theory formula. According to the Holm's contact theory formula, when assuming that D: the apparent contact surface diameter (diameter), ρ: a resistivity of a contact material, a: a radius of the true contact surface (a spot), n: a number of the true contact surfaces, a contact resistance R is calculated by $R=(\rho/D)+(\rho/2\ na)$. In the present invention, since the apparent contact surface diameter D becomes larger than that of the conventional example, the contact resistance becomes small.

Each first indent part 4 that is arranged at the position deviated from the sliding track T of the second indent part 12 can slide without running on the second indent part 12 to the utmost in the terminal insertion process or the terminal detachment process, it can prevent terminal insertion force/terminal detachment force from becoming large to the utmost.

In the present embodiment, the number of the first indent parts 4 is three, and the first indent parts 4 are arranged at the left and right symmetric positions of the sliding track T of the second indent part 12. Accordingly, so-called inclined fitting (partial contact) between the female terminal 1 and the male terminal 10 can be prevented to the utmost.

Although in the present embodiment, the number of the first indent parts 4 is three, four or more may be provided on the same circumference. In this case also, the first indent parts 4 are arranged at the left and right symmetric positions of the sliding track T of the second indent part 12. By arranging them in this way, the so-called inclined fitting (the partial contact) between the female terminal 1 and the male terminal 10 can be prevented to the utmost. In addition, if the number of the first indent parts 4 is increased, the number of the contact surfaces 4*a* can be increased.

Although in the present embodiment, each first indent part 4 is spherical in shape of its outer circumference surface, the shape of the outer circumference surface of each first indent part 4 may be a curved surface shape that the top is set at the highest position and it becomes gradually low along a smooth curved surface as it goes toward the outer circumference, an oval spherical surface, a conical surface, and a pyramid surface.

Next, a second embodiment as a reference technique will be described on the basis of the drawings.

FIG. 5 to FIG. 8 show the second embodiment. The contact-connection structure is applied to between a female terminal that is the first terminal and a male terminal that is the second terminal. In the following description will be made.

A female terminal 101 is arranged in the terminal housing chamber in the female side connector housing. (not shown). The female terminal 101 is formed by folding a conductive metal (for example, a copper alloy) that has been punched into a desired shape. A tin-plated layer (not shown) is formed on an outer surface of the female terminal 101 from the viewpoints of improvement of the connection reliability under the high-temperature environment, improvement of the corrosion resistance under the corrosive environment and so forth. The female terminal 101 has a square box part 102 that opens at a front part into which a male terminal 110 is to be inserted, and an elastic deflection part 103 that is extended from an upper surface part of this box part 102 and is arranged in the box part 102. The elastic deflection part 103 is provided with an indent part 104 that projects toward the bottom surface side. The indent part 104 is almost spherical in shape of its outer circumference surface and the central top is situated at the lowermost part. The indent part 104 can shift upward by deflective deformation of the elastic deflection part 103. In the female terminal 101, the elastic deflection part 103 and a bottom surface part 102*a* of the box part 102 form the first contact part.

The male terminal 110 is arranged in the terminal housing chamber in the male side connector housing (not shown). The male terminal 110 is formed by folding a conductive metal (for example, a copper alloy) that has been punched into a desired shape. A tin-plated layer (not shown) is formed on an outer surface of the male terminal 110 from the viewpoints of improvement of the connection reliability under the high-temperature environment, improvement of corrosion resistance under the corrosive environment and so forth. The male terminal 110 has a tabular tab part 111. In the male terminal 110, the tab part 111 forms the second contact part. A dent part 112 into which an outer circumference surface of the indent part 104 intrudes in a state of being in contact with a peripheral edge at the terminal insertion completion position is provided on the upper surface side (the contact surface side) of the tab part 111. The dent part 112 is circular when viewed from above. A diameter d2 (a diameter) of the dent part 112 is set to a size that is slightly smaller than a diameter d1 (a diameter) of a root spot of the indent part 104. A depth dp of the dent part 112 is set to a size that the top that is set at the lowermost position of the indent part 104 is not in contact with the bottom surface of the dent part 112, that is, a clearance CS is yielded, in a state where the indent part 104 has intruded into the dent part 112. The dent part 112 is formed by cutting work, pressing work and so forth.

Figure 6A:
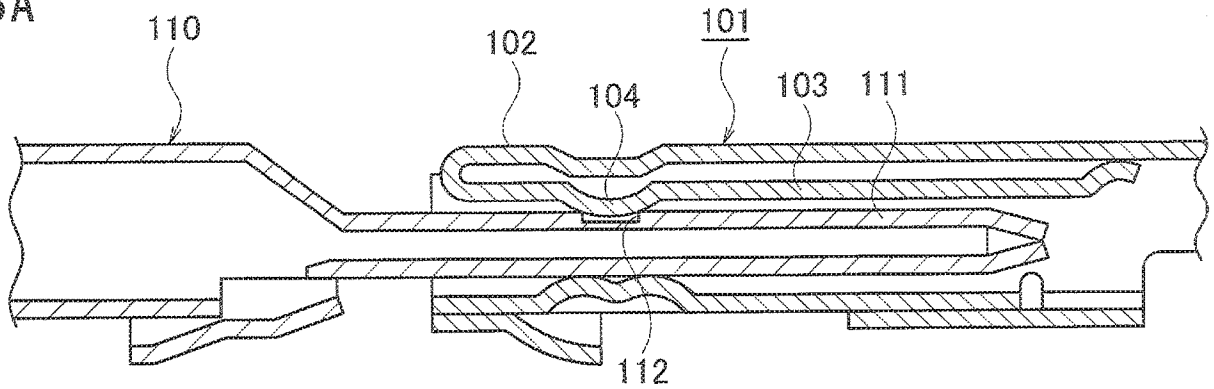
FIG. 6A shows the second embodiment as a reference technique, and is a sectional diagram of the female terminal and the male terminal in a connected state of the terminals.
Figure 6C:
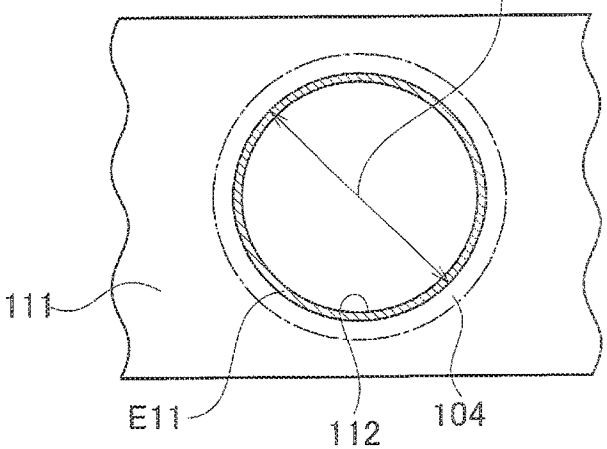
FIG. 6C shows the second embodiment as a reference technique, and is a diagram showing an apparent contact surface diameter.
Figure 6B:
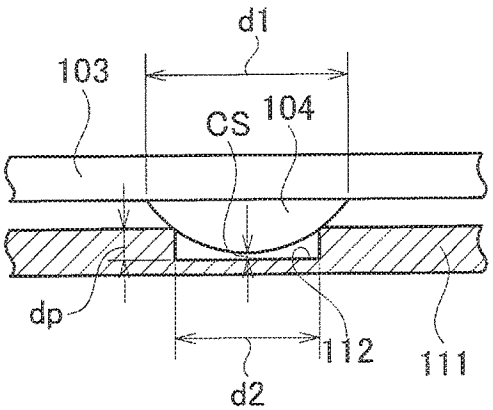
FIG. 6B shows the second embodiment as a reference technique, and is an essential part sectional diagram of a contact connection spot.
Figure 7A:
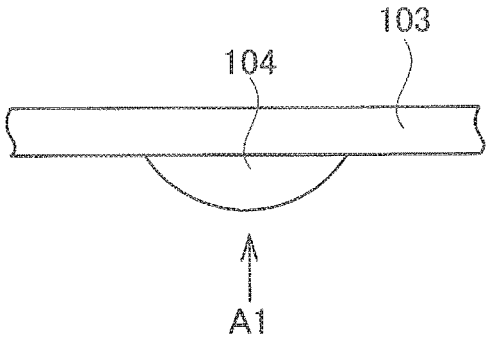
FIG. 7A shows the second embodiment as a reference technique, and is an essential part side view of an indent part of the female terminal.
Figure 7B:
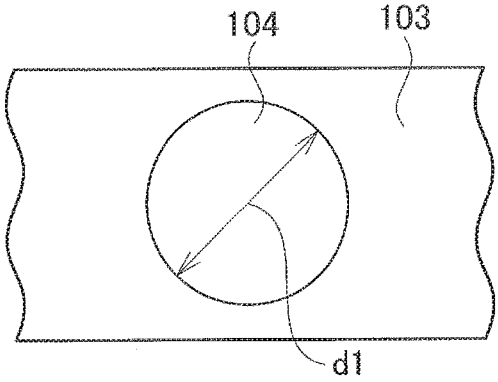
FIG. 7B shows the second embodiment as a reference technique, and is an A1 arrow view of FIG. 7A.
Figure 8A:
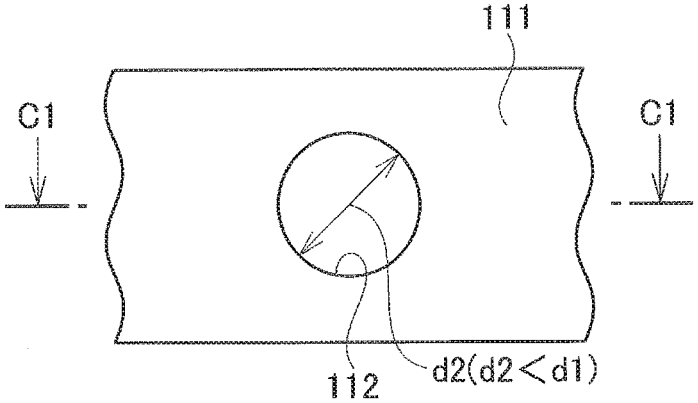
FIG. 8A shows the second embodiment as a reference technique, and is an essential part plan view of a contact part of the male terminal.
Figure 8B:
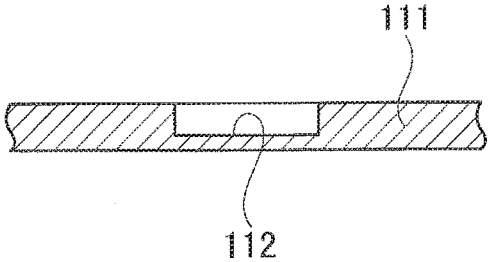
FIG. 8B shows the second embodiment as a reference technique, and is a C1-C1 line sectional diagram of FIG. 8A.

In the above-mentioned configuration, when fitting is made between the female side connector housing (not shown) and the male side connector housing (not shown), the tab part 111 of the male terminal 110 is inserted into the box part 102 of the female terminal 101 in a fitting process thereof. Then, first, a leading end of the tab part ill abuts on the elastic deflection part 103, when insertion further advances from this abutment spat, the elastic deflection part 103 deflectively deforms and insertion of the tab part 111 is allowed. In the insertion process (the terminal insertion process) of the tab part 111, the indent part 104 of the elastic deflection part 103 slides on a contact surface of the tab part 111. At the terminal insertion completion position (the connector fitting completion position), as shown in FIG. 6A, the positions of the indent part 104 of the elastic deflection part 103 and the dent part 112 in the tab part 111 align and the indent part 104 intrudes into the dent part 112 in the tab part 111 by the deflection restoring force of the elastic deflection part 103 (see FIG. 6B).

In this contact-connection structure, the dent part 112 into which the outer circumference surface of the indent part 104 of the female terminal 101 intrudes in a state of being in contact with a peripheral edge at the terminal insertion completion position is provided on the contact surface side of the tab part 111 of the male terminal 110. Accordingly, since the outer circumference side of the outer circumference surface of the indent part 104 is in electric contact with an outer edge part of the dent part 112 in the tab part 111 that abuts on it, an apparent contact surface diameter D11 (shown in FIG. 6C) becomes large in comparison with a conventional one. An apparent contact surface E11 is indicated by hatching for clarification in FIG. 6C. Moreover, a true contact surface is yielded on an outer circumference part of the apparent contact surface diameter D11. The electric current that flows between the contact parts does not averagely flow relative to the apparent contact surface diameter D11 and is easy to flow to the outer circumference part of the contact surface diameter D11, and therefore the electric current flows efficiently. From the above, the contact resistance can be reduced without upsizing and complicating to the utmost the female terminal 101 and the male terminal 110.

Next, that the contact resistance is reduced will be described by the Holm's contact theory formula. According to the Holm's contact theory formula, when assuming that D: the apparent contact surface diameter (diameter), ρ: the resistivity of the contact material, a: the radius of the true contact surface (the spot), n: the number of the true contact surfaces, the contact resistance R is calculated by $R=(\rho/D)+(\rho/2\ na)$. In the reference technique, since the apparent contact surface diameter D becomes larger than the conventional one, the contact resistance becomes small.

The outer circumference surface of the indent part 104 is almost spherical in shape, and the dent part 112 has the diameter d2 (the diameter) that is smaller than the diameter d1 (the diameter) of the root spot of the indent part 104 and has the depth that the clearance CS is yielded between it and the lowermost position of the indent part 104 that has intruded into it. Accordingly, since only the outer circumference spot of the indent part 104 surely comes into contact with the peripheral edge of the dent part 112, with the surely large apparent contact surface diameter, and moreover the true contact surface is generated on its outer circumference part and the contact resistance can be surely reduced.

Although in the present embodiment, the outer circumference surface of the indent part 104 is spherical in shape, the shape of the dent part 112 is circular conforming to this, the shape of the outer circumference surface of the indent part 104 is not limited. The indent part 104 may be a curved surface shape that the top is set at the highest position and it becomes gradually low along a smooth curved surface as it goes toward the outer circumference, a conical shape and a pyramid shape. The dent part 112 is made into the shape conforming to the shape of the indent part 104.

Next, a third embodiment as a reference technique will be described on the basis of the drawings.

FIG. 9 to FIG. 12 show the third embodiment as a reference technique.

Figure 9:
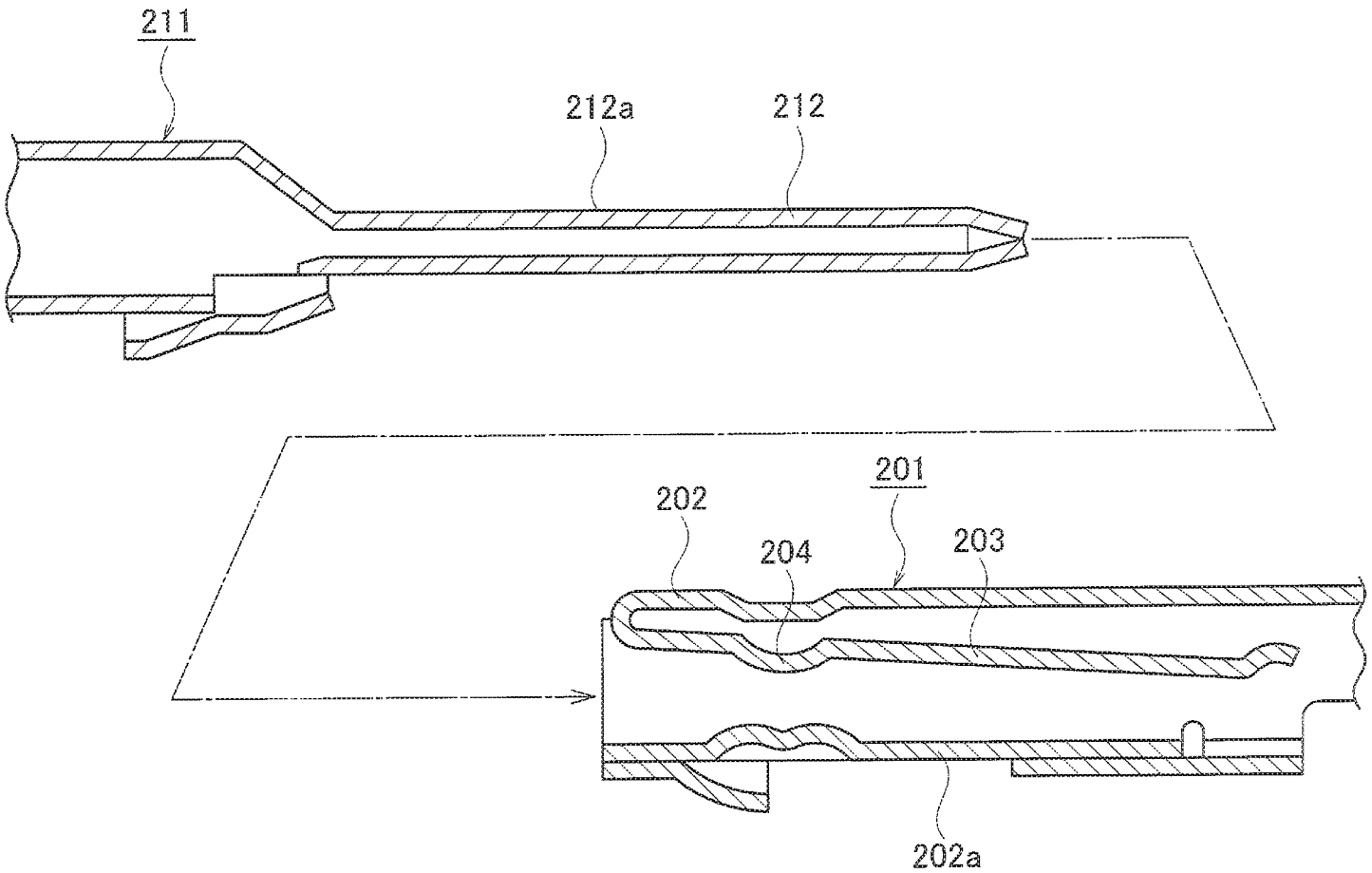
FIG. 9 shows a third embodiment as a reference technique, and is a sectional diagram of a female terminal and a male terminal before connection.
Figure 10:
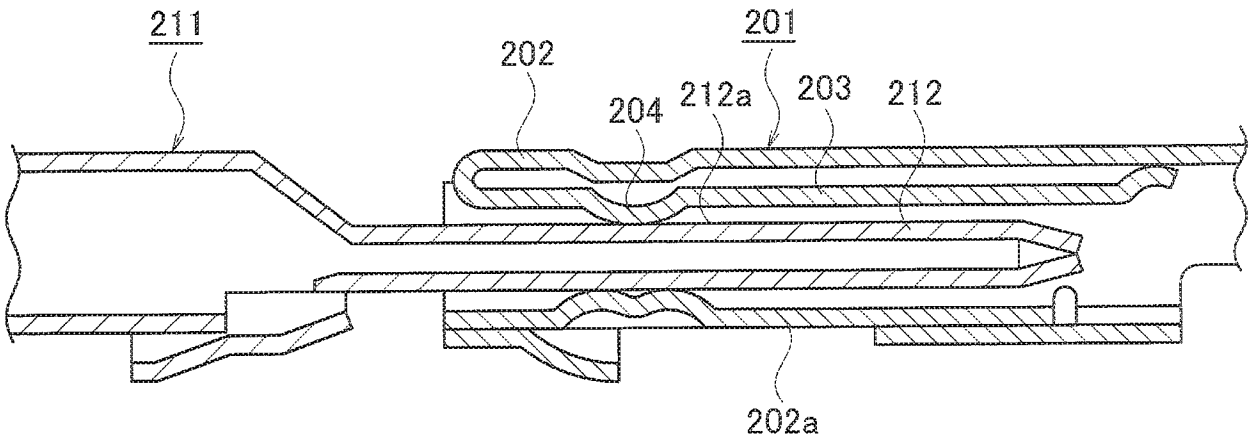
FIG. 10 shows the third embodiment as a reference technique and is a sectional diagram of the female terminal and the male terminal after connection.

A female terminal 201 shown in FIG. 9 and FIG. 10 is arranged (housed) in the terminal housing chamber in the female side connector housing (illustration is omitted).

The female terminal 201 is formed by folding a conductive metal (for example, a copper alloy) that has been punched into a desired shape.

As shown in FIG. 9 and FIG. 10, the female terminal 201 has a box part 202 that is the first contact part.

The box part 202 is square in shape that opens at a front part (the left side in FIG. 9).

An elastic deflection part 203 that has been folded from an upper surface part of the box part 202 is arranged in the box part 202.

The elastic deflection part 203 is provided with an indent part 204 that projects toward the bottom surface part 202*a* side of the box part 202.

The indent part 204 is almost spherical (an arc-shaped curved surface) in shape of an outer circumference surface (a surface facing the bottom surface part 202*a* of the box part 202), the central top is situated at the lowermost part and it shifts upward by elastic deformation of the elastic deflection part 203.

The elastic deflection part 203 and the bottom surface part 202*a* of the box part 202 that is a fixed surface part are arranged at interval.

A male terminal 211 is inserted between the elastic deflection part 203 and the bottom surface part 202*a* of the box part 202.

A later described plated layer of a conductive metal is formed on an outer surface of the female terminal 201.

The male terminal 211 is arranged (housed) in the terminal housing chamber in the male side connector housing (not shown).

The male terminal 211 is formed by folding a conductive metal (for example, a copper alloy) that has been punched into a desired shape.

The male terminal 211 has a tab part 212 that is the second contact part.

The tab part 212 has a flat tabular shape.

A conductive metal plated layer 213B that will be described later is formed on an outer surface of the male terminal 211.

Next, the plated layers of the female terminal 201 and the male terminal 211 will be described.

The plated layer of the female terminal 201 is formed on a base material of a copper alloy material.

Figure 11:
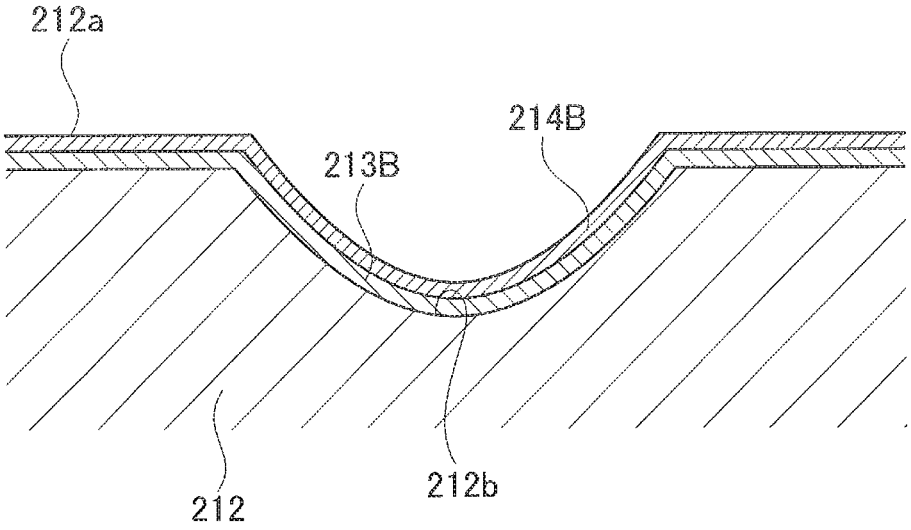
FIG. 11 shows the third embodiment as a reference technique and is an explanatory diagram corresponding to a sectional diagram showing the essential part (the contact part).

As shown in FIG. 11, in the male terminal 211, a plated layer 213B is formed on the base material of the copper alloy material that is provided with a hollow part 212*b*, on the contact surface 212*a* side of the tab part 212 and at a position corresponding to the indent part 204 that is at the terminal insertion completion position.

The hollow part 212*b* is provided at the curvature larger than the curvature of the outer circumference surface of the indent part 204.

Accordingly, the indent part 204 comes into press contact with an edge of the hollow part 212*b* so as to spread it out by force by the deflection restoring force of the elastic deflection part 203.

When force of spreading out by force acts on the edge of the hollow part 212*b* in this way, an oxide film 214B in the hollow part 212*b* and around the hollow part 212*b* is destroyed and it becomes easy to make conduction between the female terminal 201 and the male terminal 211.

Note that, when plating (tin plating) is performed and then reflow processing is performed, the plated layer 213B (a copper/tin alloy layer, a tin-plated layer) is formed on the outer surface side of the base material of the copper alloy material and the oxide film 214B is formed on an outer surface of the plated layer 213B.

Next, connection of the female terminal 201 with the male terminal 211 will be described.

When the tab part 212 of the male terminal 211 that is situated at the position in FIG. 9 is inserted into the box part 202 of the female terminal 201, the elastic deflection part 203 deflects and deforms by being pushed by the tab part 212 and thereby insertion of the tab part 212 is allowed.

Figure 12:
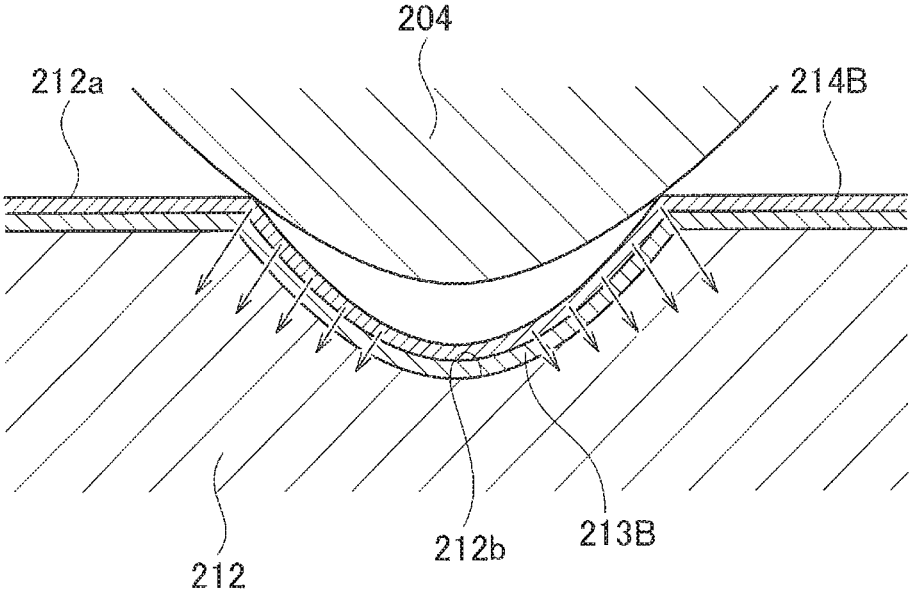
FIG. 12 shows the third embodiment as a reference technique and is an explanatory diagram showing a change of a plated layer.

In the insertion process of the tab part 212, the indent part 204 of the elastic deflection part 203 slides on the contact surface 212*a* of the tab part 212 and the indent part 204 of the elastic deflection part 203 comes into press contact with the hollow part 212*b* of the tab part 212 at the terminal insertion completion position as shown in FIG. 12.

As described above, when the indent part 204 slides on the contact surface 212*a* of the tab part 212, the deflection restoring force of the elastic deflection part 203 acts as the contact load and thereby the oxide film formed on the indent part 204 is destroyed as shown in FIG. 12 (illustrations of the plated layer and the oxide film formed on the indent part 204 are omitted).

In addition, by bringing the indent part 204 into press contact with the hollow part 212*b* of the tab part 212 at the terminal insertion completion position, since the curvature of the hollow part 212*b* is larger than the curvature of the outer circumference surface of the indent part 204, the indent part 204 comes into press contact with the edge of the hollow part 212*b*, that is, the oxide film 214B so as to spread it out by force by the deflection restoring force of the elastic deflection part 203.

When the spreading-out force acts on the oxide film 214B in this way, the oxide film 214B formed in the hollow part 212*b* and around the hollow part 212*b* is spread out by force by the indent part 204, and thereby the oxide film 214B is destroyed and the metal (for example, tin) of plating spouts out of the crack in the oxide film 214B and thereby the indent part 204 of the female terminal 201 comes into electric contact with the contact surface 212*a* of the tab part 212 of the male terminal 211.

Then, the electric current flows between the indent part 204 and the tab part 212 and thereby the female terminal 201 and the male terminal 211 are conducted.

According to the third embodiment as a reference technique, the indent part 204 causes the spreading-out force to act on the oxide film 214B funned on the edge of the hollow part 212*b* by the deflection restoring force of the elastic deflection part 203 and thereby the oxide film 214B in the hollow part 212*b* and around the hollow part 212*b* is destroyed.

Destruction of the oxide film 214B occurs in this way and thereby the metal (for example, tin) of plating spouts out of the crack in the oxide film 214B and many plating-to-plating contact parts can be ensured.

Accordingly, the contact resistance can be reduced without upsizing and complicating to the utmost the female terminal 201 and the male terminal 211.

Next, a fourth embodiment as a reference technique will be described on the basis of the drawings.

Figure 13A:
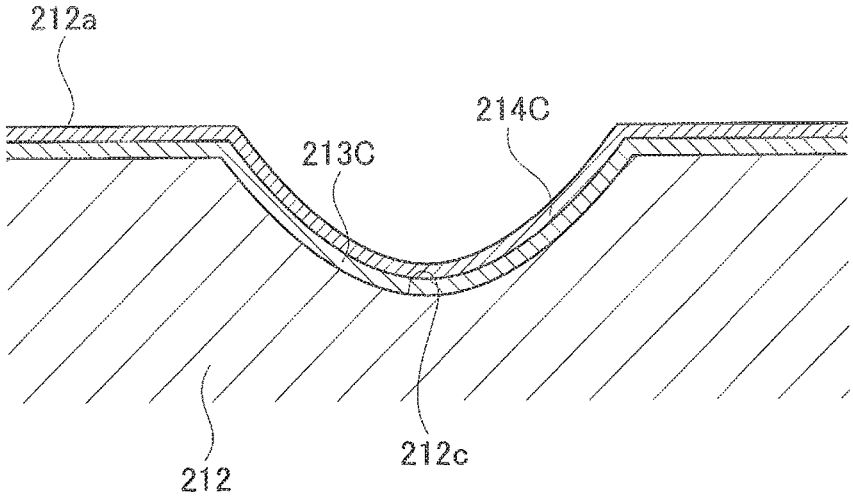
FIG. 13A shows a fourth embodiment as a reference technique, and an explanatory diagram corresponding to a sectional diagram showing the essential part (the contact part).
Figure 13B:
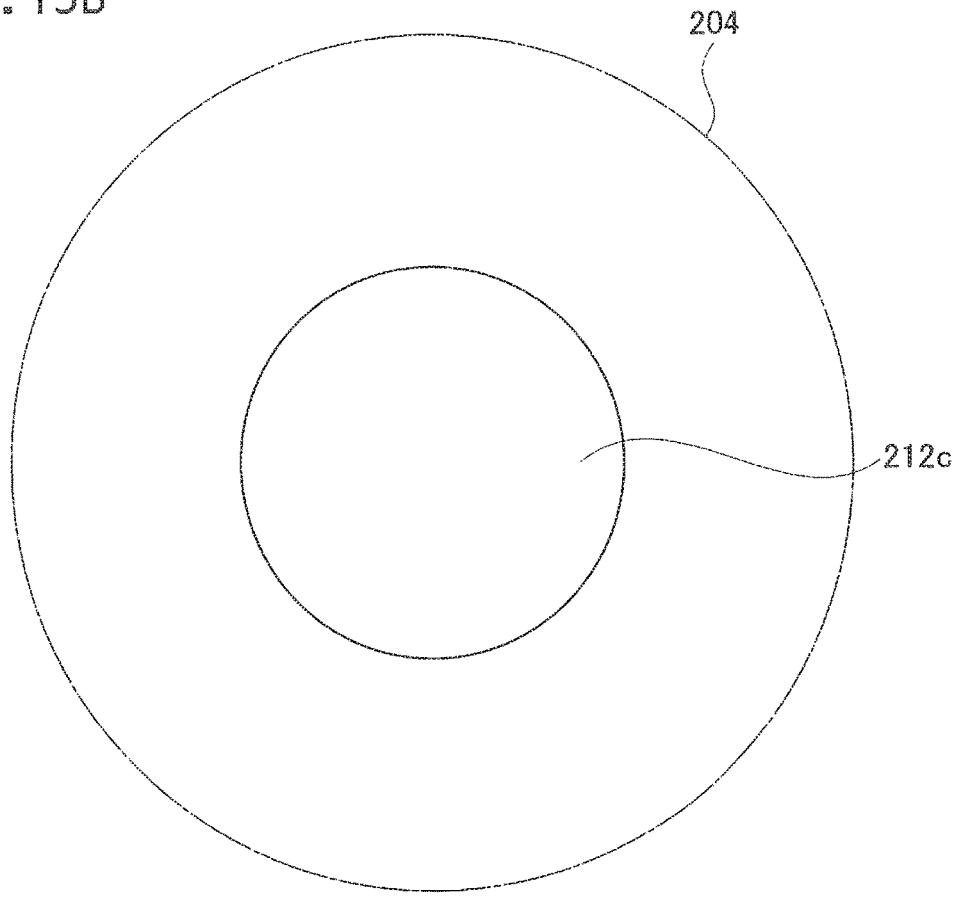
FIG. 13B shows a fourth embodiment as a reference technique, and is an explanatory diagram corresponding to a plan view showing the essential part (the contact part).
Figure 14:
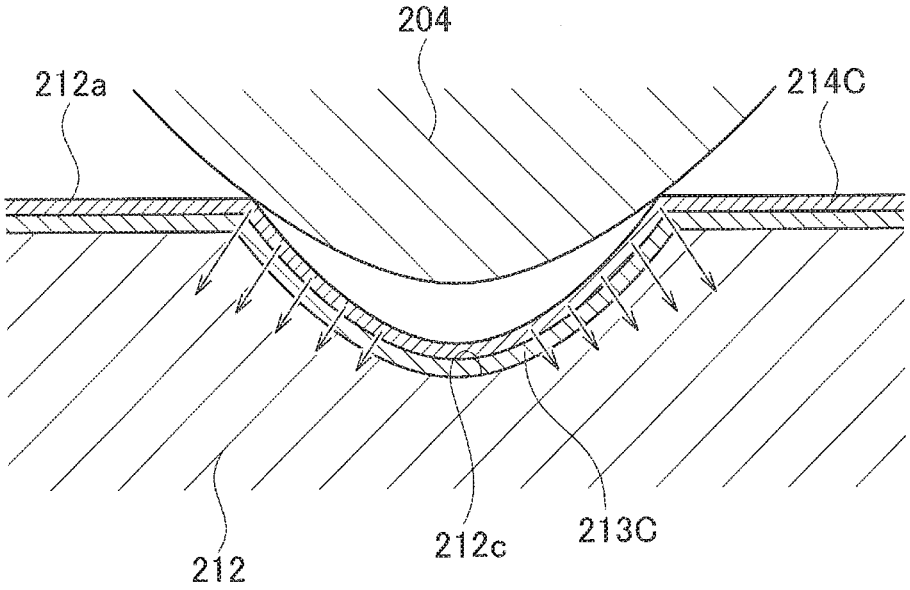
FIG. 14 shows the fourth embodiment as a reference technique and is an explanatory diagram showing a change of a plated layer.

FIG. 13 to FIG. 14 show the fourth embodiment as a reference technique. Note that the same numerals are assigned to the same parts or corresponding parts shown in FIG. 9 to FIG. 12 in FIG. 13 and FIG. 14.

This fourth embodiment is different from the third embodiment shown in FIG. 9 to FIG. 12 in that as shown in FIG. 13A and FIG. 13B, a hollow part 212*c* having an opening that is smaller than a projected planar shape of the indent part 204 is provided on the contact surface 212*a* side of the tab part 212 and at a position corresponding to the indent part 204 that is at the terminal insertion completion position.

Note that, in FIG. 13B, it is favorable that the center of the indent part 204 matches the center of the hollow part 212*c*.

Other parts are configured in the same manner as those of the third embodiment.

Next, connection of the female terminal with the male terminal will be described white referring to FIG. 9 and FIG. 10.

When the tab part 212 of the male terminal 211 that is situated at the position in FIG. 9 is inserted into the box part 202 of the female terminal 201, the elastic deflection part 203 deflects and deforms by being pushed by the tab part 212 and thereby insertion of the tab part 212 is allowed.

In the insertion process of the tab part 212, the indent part 204 of the elastic deflection part 203 slides on the contact surface 212*a* of the tab part 212, and at the terminal insertion completion position, the indent part 204 of the elastic deflection part 203 comes into press contact with the hollow part 212*c* of the tab part 212 as shown in FIG. 14.

As described above, when the indent part 204 slides on the contact surface 212*a* of the tab part 212, the deflection restoring force of the elastic deflection part 203 acts as the contact load and thereby the oxide film formed on the indent part 204 is destroyed as shown in FIG. 14 (illustration of the plated layer, the oxide film formed on the indent part 204 is omitted).

In addition, the indent part 204 comes into press contact with the hollow part 212*c* of the tab part 212 at the terminal insertion completion position and thereby, since the opening of the hollow part 212*c* is smaller than the projected planar shape of the indent part 204 as shown in FIG. 13B, the indent part 204 comes into press contact with the edge of the hollow part 212*c*, that is, an oxide film 214C so as to spread it out by force by the deflection restoring force of the elastic deflection part 203.

When the spreading-out force acts on the oxide film 214C in this way, the oxide film 214C formed in the hollow part 212*c* and around the hollow part 212*c* is spread out by force by the indent part 204 and thereby the oxide film 214C is destroyed, and the metal (for example, tin) of plating (a plated layer 213C) spouts out of the crack in the oxide film 214C and thereby the indent part 204 of the female terminal 201 comes into electric contact with the contact surface 212*a* of the tab part 212 of the male terminal 211.

Then, the electric current flows between the indent part 204 and the tab part 212 and thereby the female terminal 201 and the male terminal 211 are conducted.

According to the fourth embodiment of this invention, the indent part 204 causes the spreading-out force to act on the oxide film 214C formed on the edge of the hollow part 212*c* by the deflection restoring force of the elastic deflection part 203 and thereby the oxide film 214C in the hollow part 212*c* and around the hollow part 212*c* is destroyed.

Destruction of the oxide film 214C occurs in this way and thereby the metal (for example, tin) of plating spouts out of the crack in the oxide film 214C and many plating-to-plating contact parts can be ensured.

Accordingly, the contact resistance can be reduced without upsizing and complicating to the utmost the female terminal 201 and the male terminal 211.

Next, a fifth embodiment as a reference technique will be described on the basis of the drawings.

Figure 20:
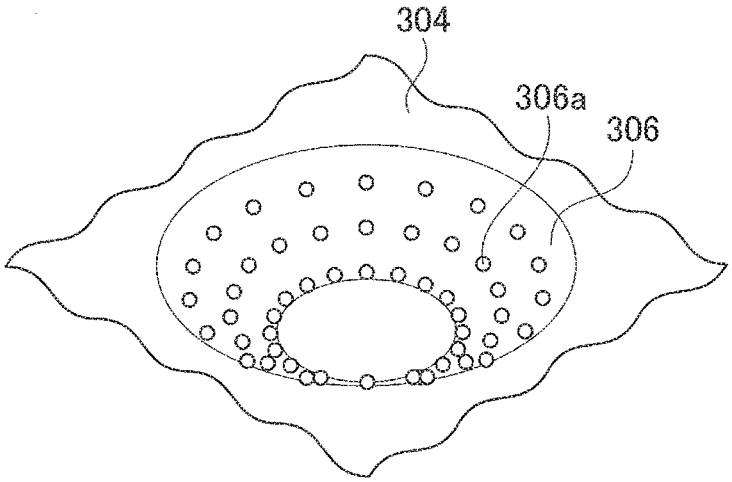
FIG. 20 shows a first modified example of the fifth embodiment as a reference technique and is a perspective view schematically showing bump parts formed on the fitting dent part.
Figure 21:
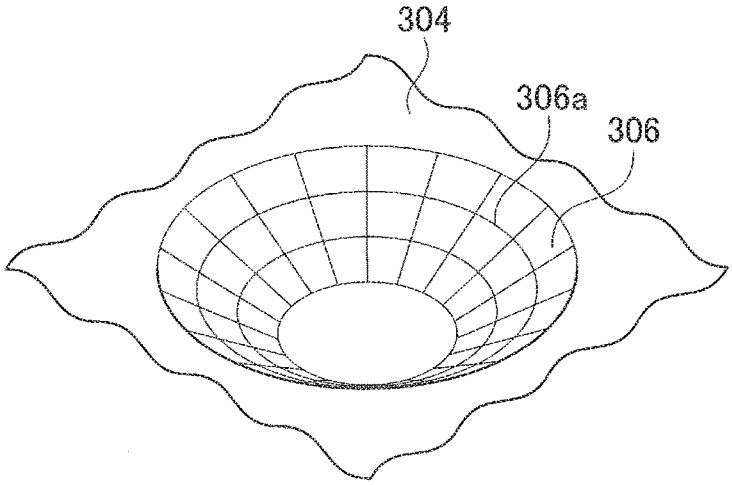
FIG. 21 shows a second modified example of the fifth embodiment as a reference technique and is a perspective view schematically showing bump parts formed on the fitting dent part.

FIG. 15 to FIG. 19 show the fifth embodiment as a reference technique. In addition, FIG. 20 and FIG. 21 show modified examples.

Figure 15:
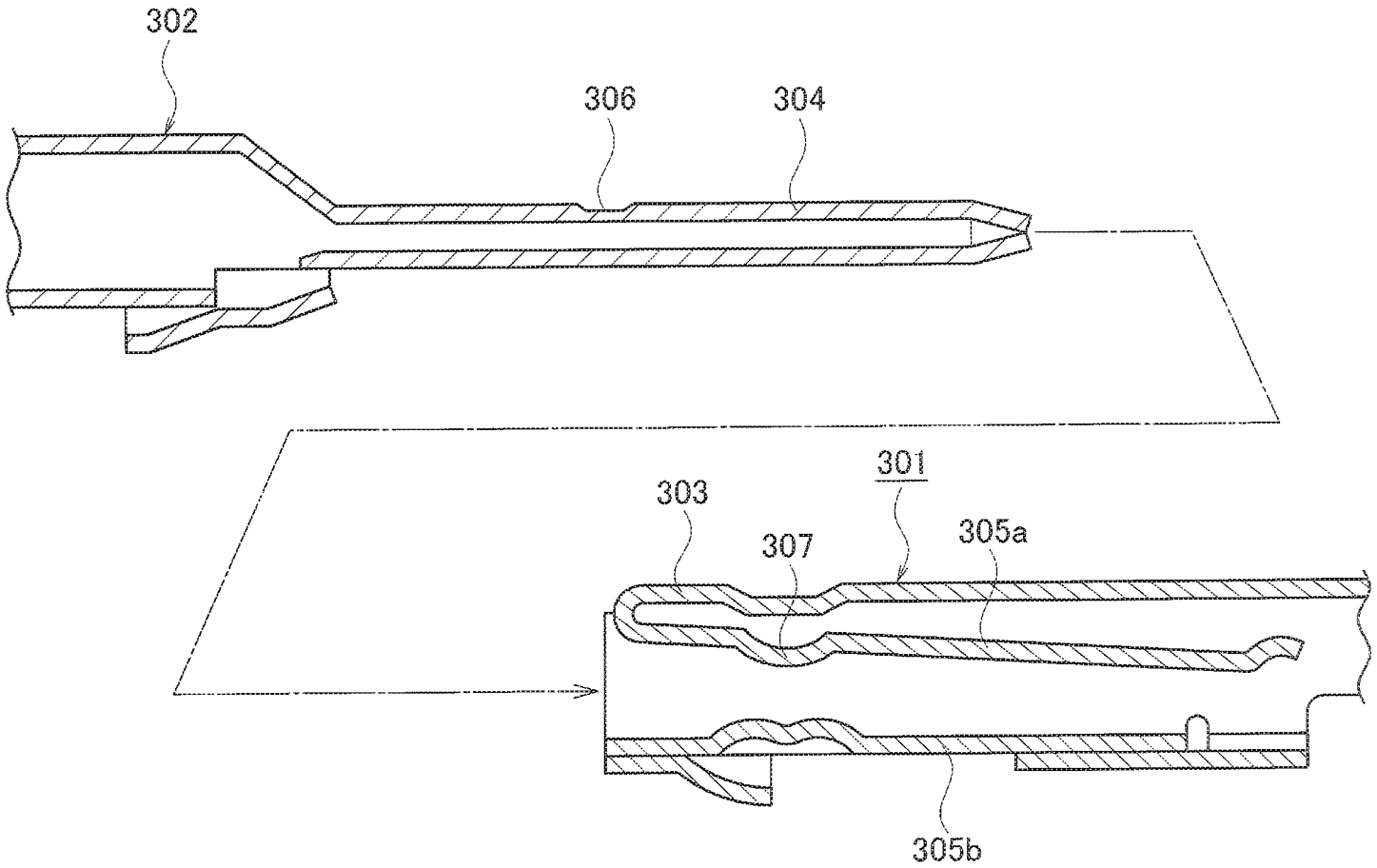
FIG. 15 shows a fifth embodiment as a reference technique and is a sectional diagram of a female terminal and a male terminal showing a state of before terminal insertion.

As shown in FIG. 15, a terminal that is used in the terminal-connection structure consists of a female terminal 301 and a male terminal 302. The female terminal 301 is arranged in the terminal housing chamber in the not shown female side connector housing.

This female terminal 301 is plated with tin on a surface and possesses a box part 303 as the first contact part.

The box part 303 is formed into a square shape that opens at a front part and possesses an elastic deflection part 305*a* formed by folding inward an upper surface and a bottom surface part 305*b* that is provided so as to project from a lower surface toward the upper surface.

The elastic deflection part 305*a* has elasticity and is formed inclingly from the upper surface toward the lower surface of the box part 303. In addition, an indent part 307 that projects toward the bottom surface side is formed in a surface of the elastic deflection part 305*a*.

The indent part 307 spherically projects out of the elastic deflection part 305*a* and a central position is situated at the lowermost part of the spherical shape. Since the indent part 307 is formed in the elastic deflection part 305*a*, it is displaceable in an up-down direction.

The bottom surface part 305*b* is formed at a position almost facing the indent part 307 with a predetermined space, and the male terminal 302 is inserted between the bottom surface part 305*b* and the indent part 307.

The male terminal 302 is plated with tin on a surface and possesses a tab part 304 as the second contact part.

The leading end of the tab part 304 is inserted between the bottom surface part 305*b* of the female terminal 301 and the indent part 307.

In the present embodiment, a fitting dent part 306 is formed in a surface of the tab part 304 that faces the indent part 307 and is made such that the indent part 307 fits into this fitting dent part 306 at the terminal insertion completion position.

This fitting dent part 306 is formed by press forming. Then, the fitting dent part 306 is formed into a tapered shape that the diameter is increased toward the opening side viewed in section, and has an almost flat bottom surface part 306*c* and an inclined surface part 306*d* that is inclined on a side part. This bottom surface part 306*c* and the inclined surface part 306*d* form a surface 306*b* of the fitting dent part 306.

Figure 36:
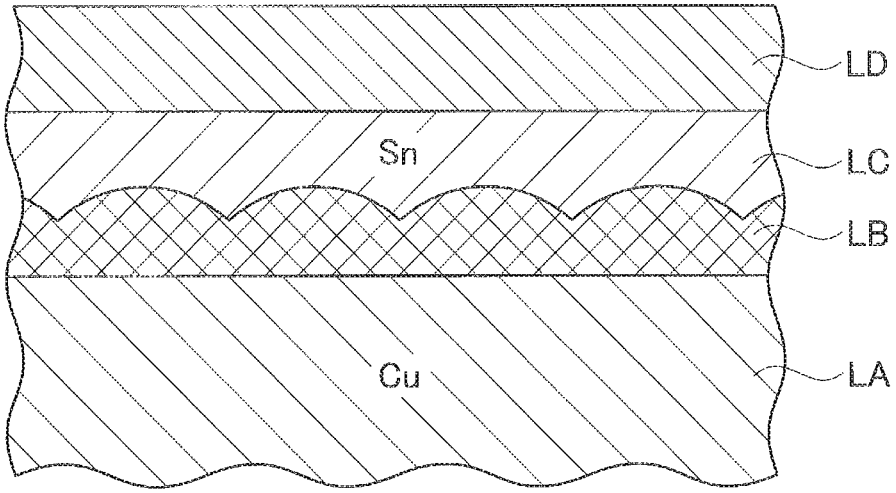
FIG. 36 is a schematic diagram showing the plated layer of the terminal.

Incidentally, a tin plating treatment is performed over the entire areas of outer surfaces of the elastic deflection part 305*a* and the tab part 304, a copper/tin alloy layer LB and a tin-plated layer LC are formed on the outer surface side of a base material layer LA of a copper alloy material and an oxide film LD is generated on an outer surface of the tin-plated layer LC (see FIG. 36).

Since this oxide film LD is very high in electric resistivity in comparison with tin and copper, even when the oxide films LD are mutually brought into contact with each other, favorable electric connection cannot be obtained.

Accordingly, it is general to obtain more favorable electric connection by destroying this oxide film LD under the contact load between the contact surfaces of the indent part 307 and the tab part 304 so as to mutually bring plated metals of the indent part 307 and the tab part 304 into contact with each other at a spot where the oxide film LD has been destroyed.

At this time, it is favorable to enable further promotion of destruction of the oxide film LD.

Accordingly, in the present embodiment, it is enabled to further promote destruction of the oxide film ID.

Specifically, a bump part 306*a* (at least either a dent part or a bump part) is formed on the surface 306*b* of the fitting dent part 306.

When the contact load has worked between the contact surfaces of the indent part 307 and the fitting dent part 306 by forming the bump part 306*a* (at least either the dent part or the bump part) on the surface 306*b* of the fitting dent part 306, a local pressure can be applied between the contact surfaces of the indent part 307 and the fitting dent part 306 by the dent part and the bump part 306*a*.

Here, the present inventors have grasped visually that when the load is applied between the contact surfaces of the indent part 307 and the tab part 304, the oxide film LD concentrically or radially cracks at a plurality of spots.

Therefore, it has been made such that the bump parts 306*a* (at least either the dent parts or the bump parts) to be formed on the surface 306*b* of the fitting dent part 306 are arranged in at least either a radial state or a concentric state so as to further promote concentric or radial cracking of the oxide film LD.

Figure 19:
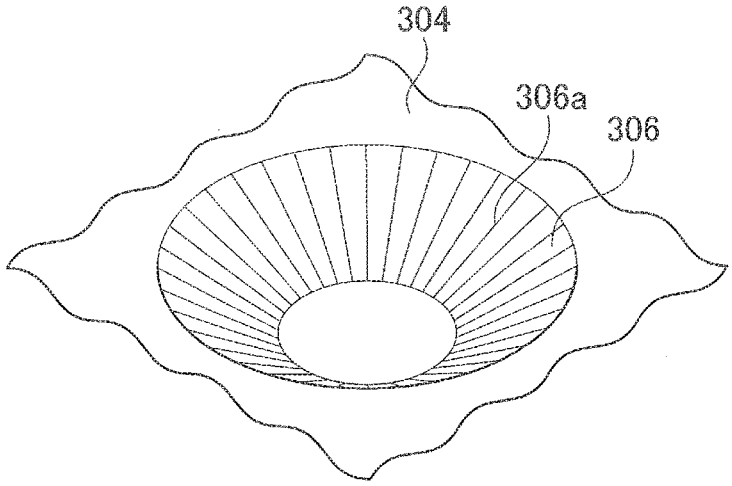
FIG. 19 shows the fifth embodiment as a reference technique and is a perspective view schematically snowing bump parts formed on the fitting dent part.

In the present embodiment, the bump parts 306*a* (at least either the dent parts or the bump parts) are lineally formed in plurality on the inclined surface part (the surface) such that they are radially formed as a whole as shown in FIG. 19.

Next, one example of a state where the female terminal 301 and the male terminal 302 are electrically connected to each other will be described.

First, as shown in FIG. 15, the tab part 304 of the male terminal 302 is inserted from the opening side of the box part 303 of the female terminal 301. The tab part 304 that has been inserted through the opening in the box part 303 is inserted between the indent part 307 and the bottom surface part 305*b*. At this time, the tab part 304 slides to the indent part 307 and the bottom surface part 305*b*, pushes upward the elastic deflection part 305*a*, and elastically deforms in a direction that the indent part 307 and the bottom surface part 305*b* separate from each other.

Figure 16:
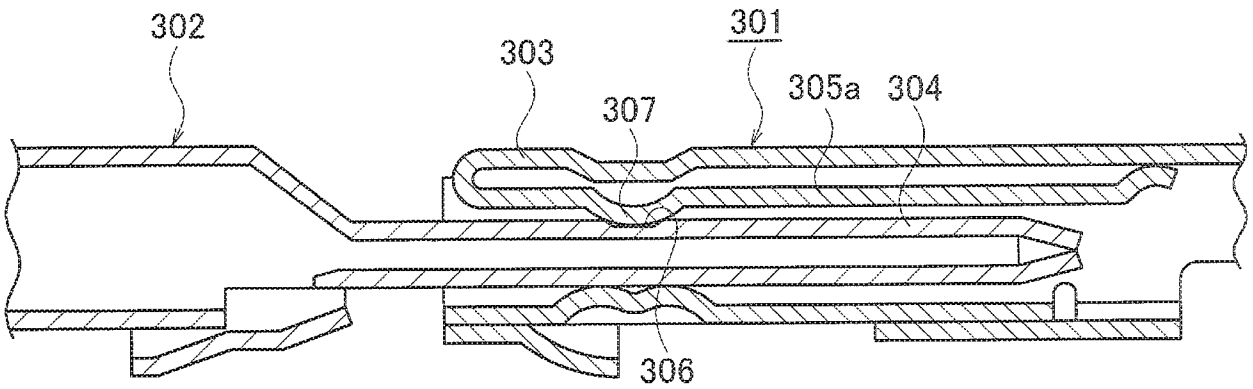
FIG. 16 shows the fifth embodiment as a reference technique and is a sectional diagram of the female terminal and the male terminal showing a state of a terminal insertion completion position.

When the tab part 304 is further inserted into the female terminal 301, it reaches the terminal insertion completion position shown in FIG. 16 and the indent part 307 is fitted into the fitting dent part 306.

In a state where the tab part 304 has been inserted up to the terminal insertion completion position in this was, the deflection restoring force is generated in the elastic deflection part 305*a* and thus the contact load works between the contact surfaces of the indent part 307 and the fitting dent part 306 by this deflection restoring force.

At this time, the surface of the indent part 307 is locally pressed by the bump part 306*a* (at least either the dent part or the bump part) formed on the fitting dent part 306. In the present embodiment, the surface of the indent part 307 is radially pressed.

Figure 17:
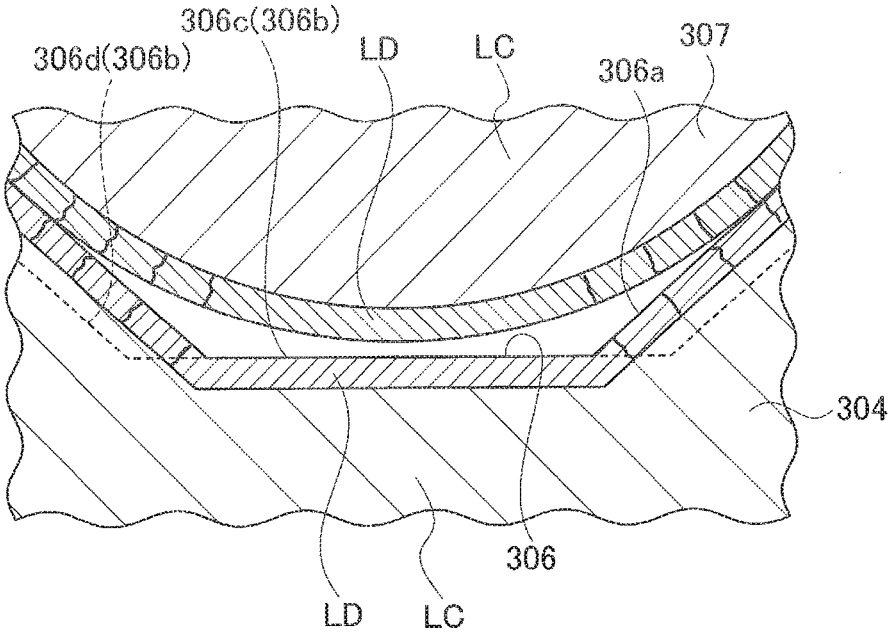
FIG. 17 shows the fifth embodiment as a reference technique and is an explanatory diagram explaining a state where oxide films formed on an indent part and a fitting dent part are destroyed.

As a result, radial cracking of the oxide film LD on the surface of the indent part 307 is promoted and cracks are generated in the oxide film LD (see FIG. 17). On the other hand, since pressing force also works on the bump part 306*a* (at least either the dent part or the bump part) concentratedly, the cracks are also easy to generate in the oxide film LD on the bump part 306*a* (at least either the dent part or the bump part) (see FIG. 17).

Figure 18:
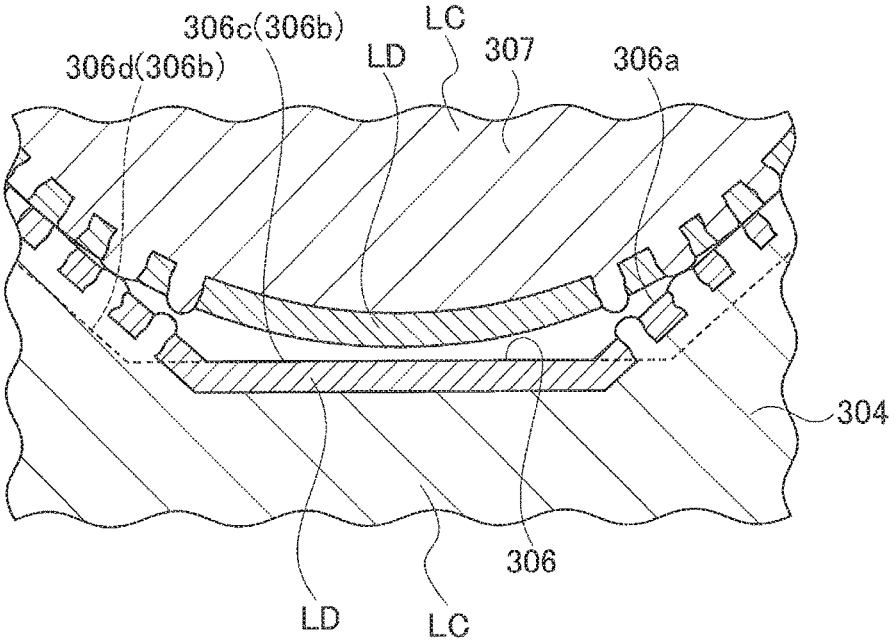
FIG. 18 shows the fifth embodiment as a reference technique and is an explanatory diagram explaining a state where the oxide films formed on the indent part and the fitting dent part are destroyed and the plated metals mutually come into contact with each other.

Then, when the cracks are generated in the oxide film LD, the tin-plated layer LC intrudes into the surface through a gap in the oxide film LD (see FIG. 18).

The tin-plated layer LC intrudes into the surface through the gap in the oxide film LD in this way, and thereby the mutual tin-plated layers LC (the mutual plated metals of the indent part 307 and the fitting dent part 306) come into contact with each other and more favorable electric connection can be obtained as shown in FIG. 18.

As described above, in the present embodiment, it is formed such that at least either the dent parts or the bump parts 306*a* are arranged on the surface of the fitting dent part 306 in at least either the radial state or the concentric state.

When the contact load has worked between the contact surfaces of the indent part 307 and the fitting dent part 306 by forming the dent parts and the bump parts 306*a* in this way, a local pressure can be applied between the contact surfaces of the indent part 307 and the fitting dent part 306 by the dent parts and the bump parts 306*a*.

As a result, destruction of the oxide films LD formed on the surface of the indent part 307 and the surface of the fitting dent part 306 is promoted and contact between the mutual plated metals of the indent part 307 and the fitting dent part 306 can be obtained at the spots where the oxide films LD have been destroyed.

Accordingly, the contact resistance can be reduced without upsizing and complicating to the utmost the terminals. In particular, according to the present embodiment, even when the contact pressure between the contact parts has become small, it becomes possible to destroy the oxide films LD and therefore there is such an advantageous effect that it becomes easy to promote downsizing of the terminals.

Note that there is no need to provide the bump parts 306*a* continuously and linearly, it is also possible to provide the bump parts 306*a* so as to be dotted about radially as shown in FIG. 20. The shape of each bump part 306*a* to be formed at that time can be appropriately set to a circle, a triangle, a square and so forth. In addition, each bump part 306*a* can be formed by, for example, emboss processing.

In addition, it is also possible to provide the bump parts 306*a* in the form of a lattice as shown in FIG. 21. That is, it is also possible to form the bump parts 306*a* such that they are arranged radially and concentrically.

In addition, the bump parts 306*a* may be formed concentrically.

Note that the dent parts may be formed in the surface of the fitting dent part 306. If the dent parts are formed in this way, destruction of the oxide film LD will be promoted by an edge part of the dent part end edge.

In addition, in the present embodiment, although the tin-plated layers are formed on the surfaces of the elastic deflection part 305*a* and the tab part 304, if the plated layer is the one in which an oxide film other than tin is formed, the reference technique can obtain the same advantageous effect.

Next, a sixth embodiment as a reference technique will be described on the basis of the drawings.

Figure 22:
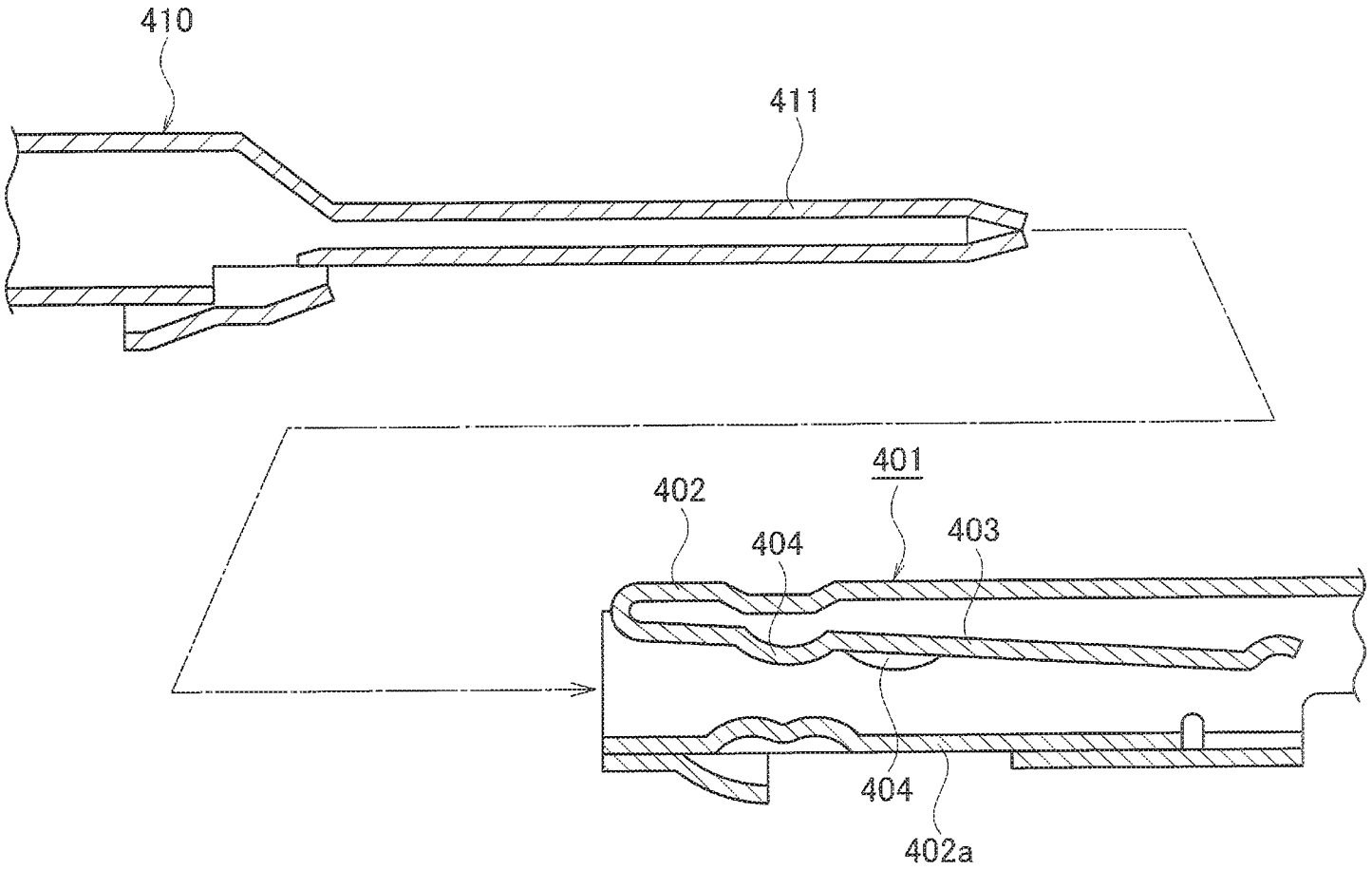
FIG. 22 shows a sixth embodiment as a reference technique and is a sectional diagram of a female terminal and a male terminal before terminal connection.
Figure 23A:
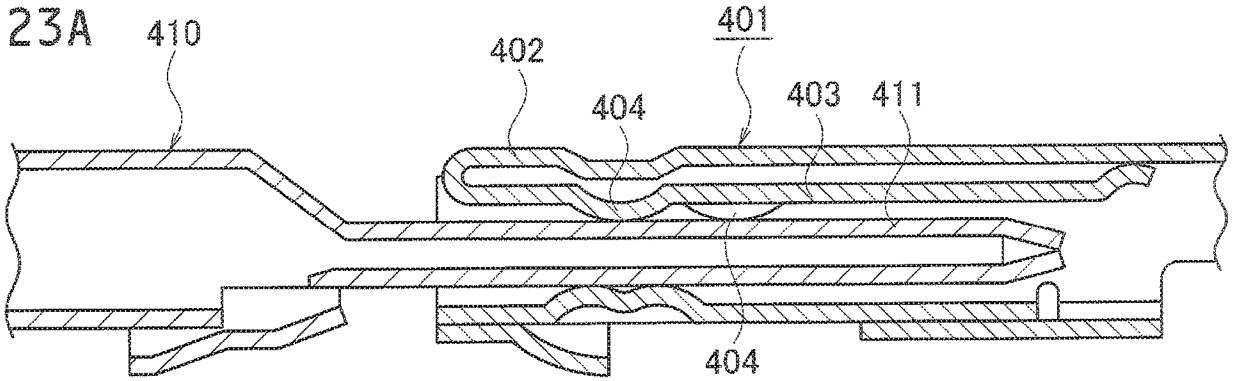
FIG. 23A shows the sixth embodiment as a reference technique, and is a sectional diagram of the female terminal and the male terminal in a connected state of the terminals.
Figure 23B:
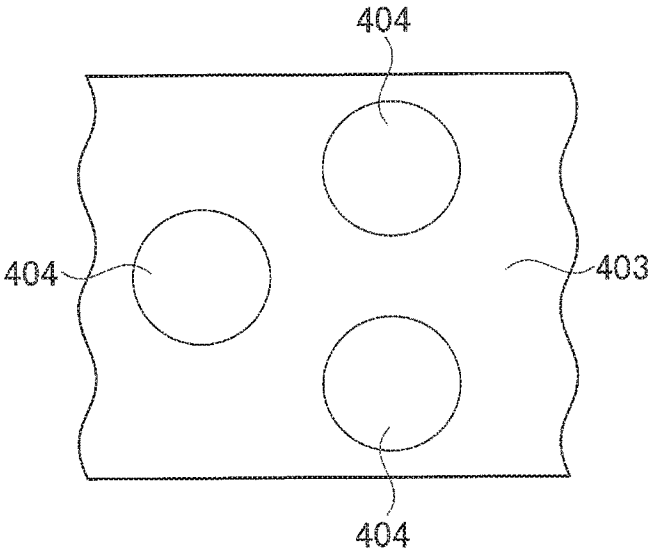
FIG. 23B shows the sixth embodiment as a reference technique, and is a diagram viewing the essential part of an elastic deflection part from below.
Figure 23C:
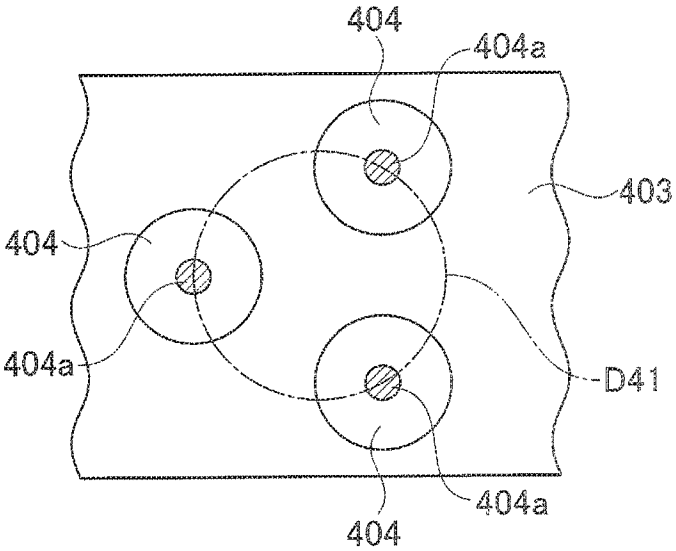
FIG. 23C shows the sixth embodiment as a reference technique, and is a diagram showing an indent part and an apparent contact surface diameter.
Figure 24:
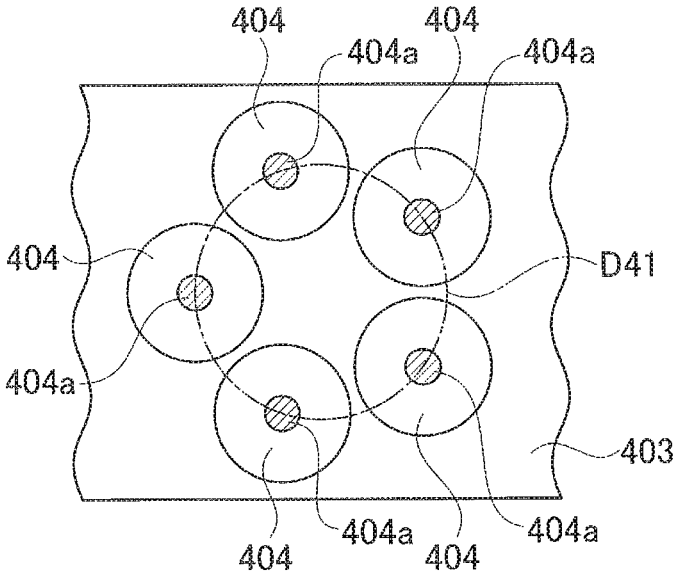
FIG. 24 shows a modified example of the sixth embodiment as a reference technique and is a diagram showing the indent part and the apparent contact surface diameter.
Figure 25:
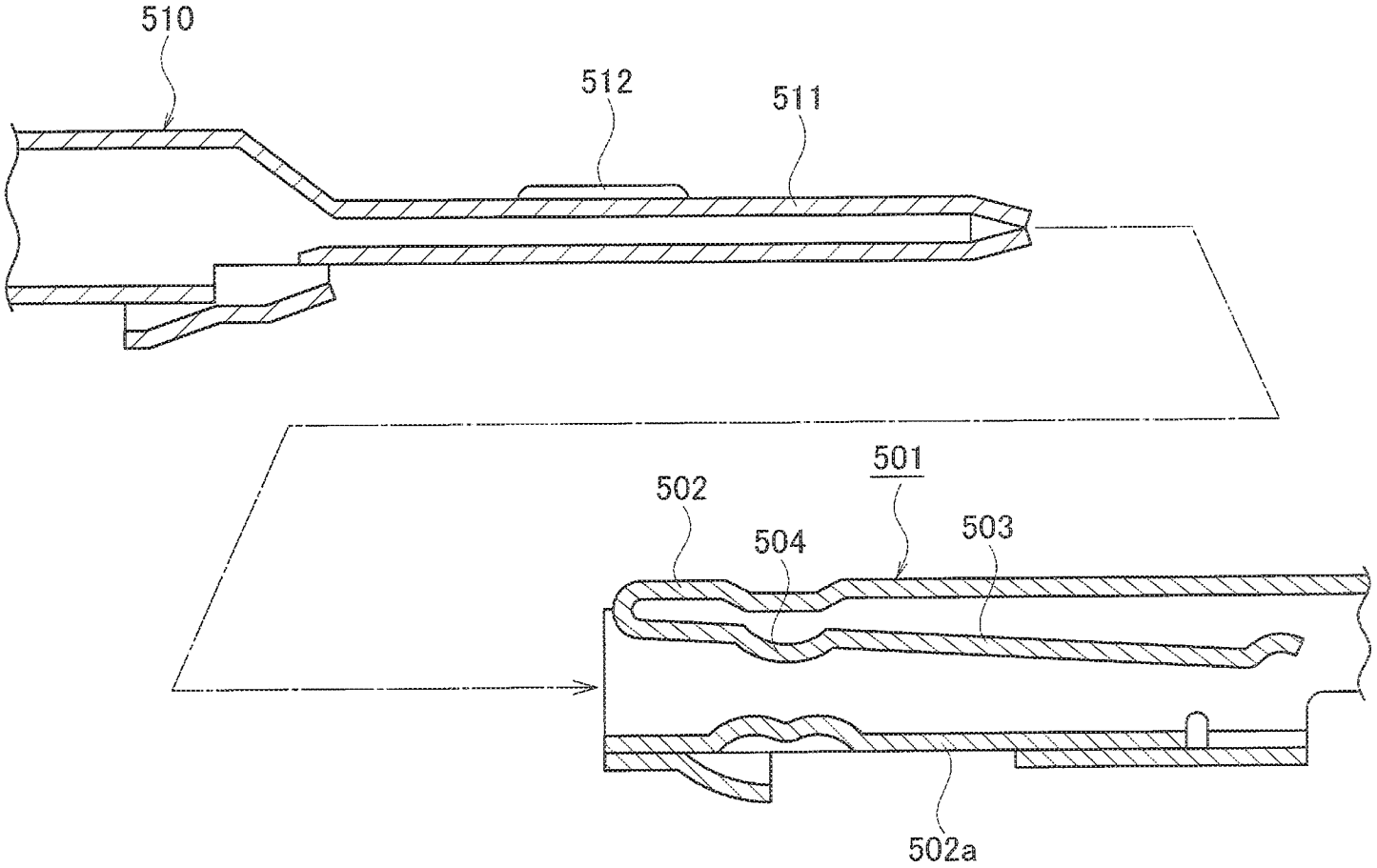
FIG. 25 shows a seventh embodiment as a reference technique and is a sectional diagram of a female terminal and a male terminal before terminal connection.
Figure 27A:
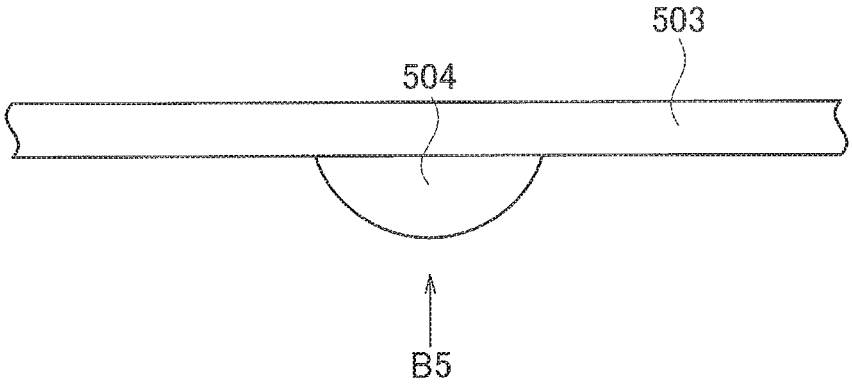
FIG. 27A shows the seventh embodiment as a reference technique, and is a side view of the indent part spot of the female terminal.
Figure 27B:
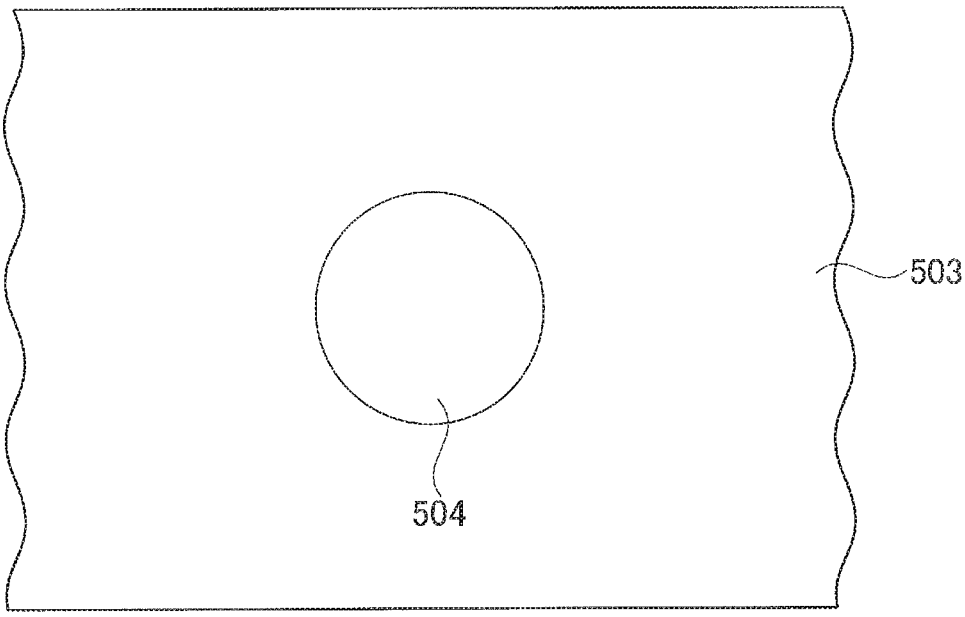
FIG. 27B shows the seventh embodiment as a reference technique, and is a 135 arrow view of FIG. 27A.

FIG. 22 and FIG. 23 show the sixth embodiment as a reference technique. In addition, FIG. 24 shows a modified example of the present embodiment.

As shown in FIG. 22 and FIG. 23, the contact-connection structure is applied between a female terminal that is the first terminal and a male terminal that is the second terminal.

A female terminal 401 is arranged in the terminal housing chamber in the female side connector housing (not shown). The female terminal 401 is formed by folding a conductive metal (for example, a copper alloy) that has been punched into a desired shape. A tin-plated layer (not shown) is formed on an outer surface of the female terminal 401 from the viewpoints of improvement of the connection reliability under the high-temperature environment, improvement of the corrosion resistance under the corrosive environment and so forth. The female terminal 401 has a square box part 402 that opens at a front part into which a male terminal 410 is to be inserted, and an elastic deflection part 403 that is extended from an upper surface part of this box part 402 and is arranged in the box part 402. The elastic deflection part 403 is provided with three indent parts 404 that project toward the bottom surface side. The three indent parts 404 are arranged at positions on the same circumference and at equal intervals (see FIG. 23B, FIG. 23C). Each indent part 404 is almost spherical in shape of its outer circumference surface and the central top is situated at the lowermost part. The indent part 404 can shift upward by deflective deformation of the elastic deflection part 403. In the female terminal 401, the elastic deflection part 403 and a bottom surface part 402*a* of the box part 402 form the first contact part.

The male terminal 410 is arranged in the terminal housing chamber in the male side connector housing (not shown).

The male terminal 410 is formed by folding a conductive metal (for example, a copper alloy) that has been punched into a desired shape. The tin-plated layer (not shown) is formed on an outer surface of the male terminal 410 from the viewpoints of improvement of the connection reliability under the high-temperature environment, improvement of the corrosion resistance under the corrosive environment and so forth. The male terminal 410 has a tabular tab part 411. In the male terminal 410, the tab part 411 forms the second contact part.

In the above-mentioned configuration, when fitting is made between the female side connector housing (not shown) and the male side connector housing (not shown), the tab part 411 of the male terminal 410 is inserted into the box part 402 of the female terminal 401 in the fitting process thereof. Then, first, a leading end of the tab part 411 abuts on the elastic deflection part 403, when insertion further advances from this abutment spot, the elastic deflection part 403 deflectively deforms and insertion of the tab part 411 is allowed. In the insertion process the terminal insertion process) of the tab part 411, the indent part 404 of the elastic deflection part 403 slides on a contact surface of the tab part 411. At the terminal insertion completion position (the connector fitting completion position), as shown in FIG. 23A, the three indent parts 404 and the tab part 411 come into contact with one another using deflection restoring force of the elastic deflection part 403 as a contact load. When describing in detail, the top sport of each indent part 404 serves as a contact surface 404*a* with the tab part 411. In FIG. 23C, the contact surface 404*a* is indicated by hatching for clarification.

In this contact-connection structure, the three indent parts 404 are arranged on the same circumference. Accordingly, since a diameter on the circumference on which the contact surfaces 404*a* (shown in FIG. 23C) of the three indent parts 404 are arranged can be regarded as an apparent contact surface diameter D41, the apparent contact surface diameter D41 is large in comparison with that of the conventional example and the true contact surface (in a region of the contact surface 404*a*) is yielded on an outer circumference spot of the apparent contact surface diameter D41. The electric current that flows through the contact part does not averagely flow relative to the apparent contact surface diameter D41 and is easy to flow to the outer circumference part of the contact surface diameter D41, and therefore it flows efficiently. From the above, the contact resistance can be reduced without upsizing and complicating to the utmost the female terminal 401 and the male terminal 410.

Next, that the contact resistance is reduced will be described by the Holm's contact theory formula. According to the Holm's contact theory formula, when assuming that D: the apparent contact surface diameter (diameter), ρ: the resistivity of the contact material, a: the radius of the true contact surface (the spot), the number of the true contact surfaces, the contact resistance R is calculated by $R=(\rho/D)+(\rho/2\ na)$. In this reference technique, since the apparent contact surface diameter D becomes larger than that of the conventional example, the contact resistance R becomes small by the above-mentioned formula.

It is favorable that at least three indent parts 404 are arranged at the positions on the same circumference. In FIG. 24, a modified example in which the five indent parts 404 are arranged at equal intervals is shown. The contact surface 404*a* is clarified by being indicated by hatching.

In this modified example also, the contact resistance can be reduced without upsizing and complicating to the utmost the terminals by the same reasons as those of the above mentioned embodiment.

In the above-mentioned embodiment and the above mentioned modified example, although the outer circumference surface of each indent part 404 is spherical, the shape of the outer circumference surface of each indent part 404 is not limited thereto. For example, it may be a curved surface shape that the top is set at the highest position and it becomes gradually low along a smooth curved surface as it goes toward the outer circumstance, a conical shape, a pyramid shape.

Next, a seventh embodiment as a reference technique will be described on the basis of the drawings.

FIG. 25 to FIG. 28 show the seventh embodiment as a reference technique. The contact-connection structure is applied between a female terminal that is the first terminal and a male terminal that is the second terminal. In the following description will be made.

A female terminal 501 is arranged in the terminal housing chamber in the female side connector housing (not shown). The female terminal 501 is formed by folding a conductive metal (for example, a copper alloy) that has been punched into a desired shape. A tin-plated layer (not shown) is formed on an outer surface of the female terminal 501 from the viewpoints of improvement of the connection reliability under the high-temperature environment, improvement of the corrosion resistance under the corrosive environment and so forth. The female terminal 501 has a square box part 502 that opens at a front part into which a male terminal 510 is to be inserted, and an elastic deflection part 503 that is extended from an upper surface part of this box part 502 and is arranged in the box part 502. The elastic deflection part 503 is provided with an indent part 504 that projects toward the bottom surface side. The indent part 504 is almost spherical in shape of its outer circumference surface and the central top is situated at the lowermost part. The indent part 504 can shift upward by deflective deformation of the elastic deflection part 503. In the female terminal 501, the elastic deflection part 503 and a bottom surface part 502*a* of the box part 502 form the first contact part.

The male terminal 510 is arranged in the terminal housing chamber in the male side connector housing (not shown). The male terminal 510 is formed by folding a conductive metal (for example, a copper alloy) that has been punched into a desired shape. A tin-plated layer (not shown) is formed on an outer surface of the male terminal 510 from the viewpoints of improvement of the connection reliability under the high-temperature environment, improvement of the corrosion resistance under the corrosive environment and so forth. The male terminal 510 has a tabular tab part 511. One pair of projected walls 512 are provided on an upper surface of the tab part 511. One pair of the projected walls 512 are arranged at interval in a direction orthogonal to an insertion direction M (a sliding direction) of the indent part 504. A central position of one pair of the projected walls 512 is set as an insertion position of the indent part 504. Accordingly, the central spot of the indent part 504 slides so as to intrude into between one pair of the projected walls 512 and it reaches the terminal insertion completion position. A height of one pair of the projected walls 512 is set to a height that, at the terminal insertion completion position, both sides of the outer circumference surface of the indent part 504 are in contact with one pair of the projected walls 512 and a central spot (the top spot) of the outer circumference surface of the indent part 504 is in contact with a contact surface of the tab part 511. In the male terminal 510, the tab part 511 forms the second contact part.

Figure 28A:
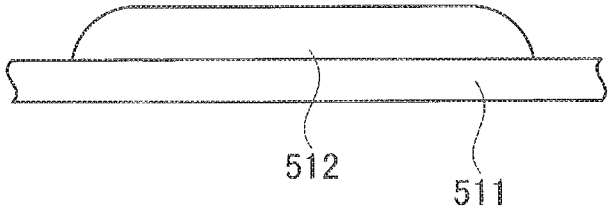
FIG. 28A shows the seventh embodiment as a reference technique, and is an essential part side view of a tab part.
Figure 28B:
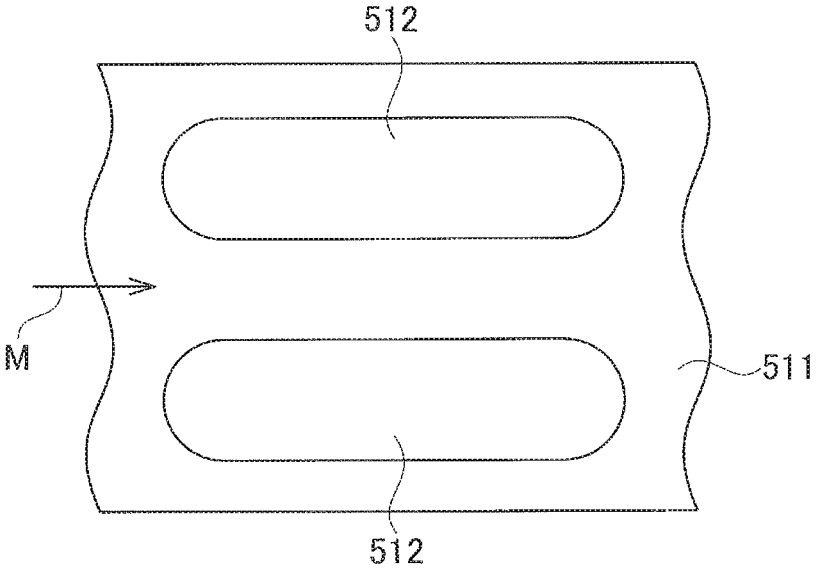
FIG. 28B shows the seventh embodiment as a reference technique, and is an essential part plan view of the tab part.
Figure 28C:
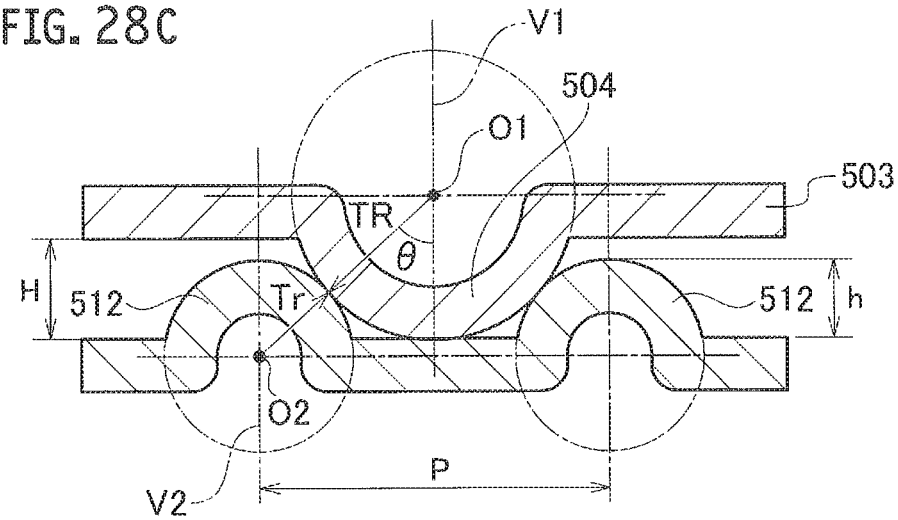
FIG. 28C shows the seventh embodiment as a reference technique, and is a diagram explaining a dimension relation between the indent part and one pair of projected walls.
Figure 29:
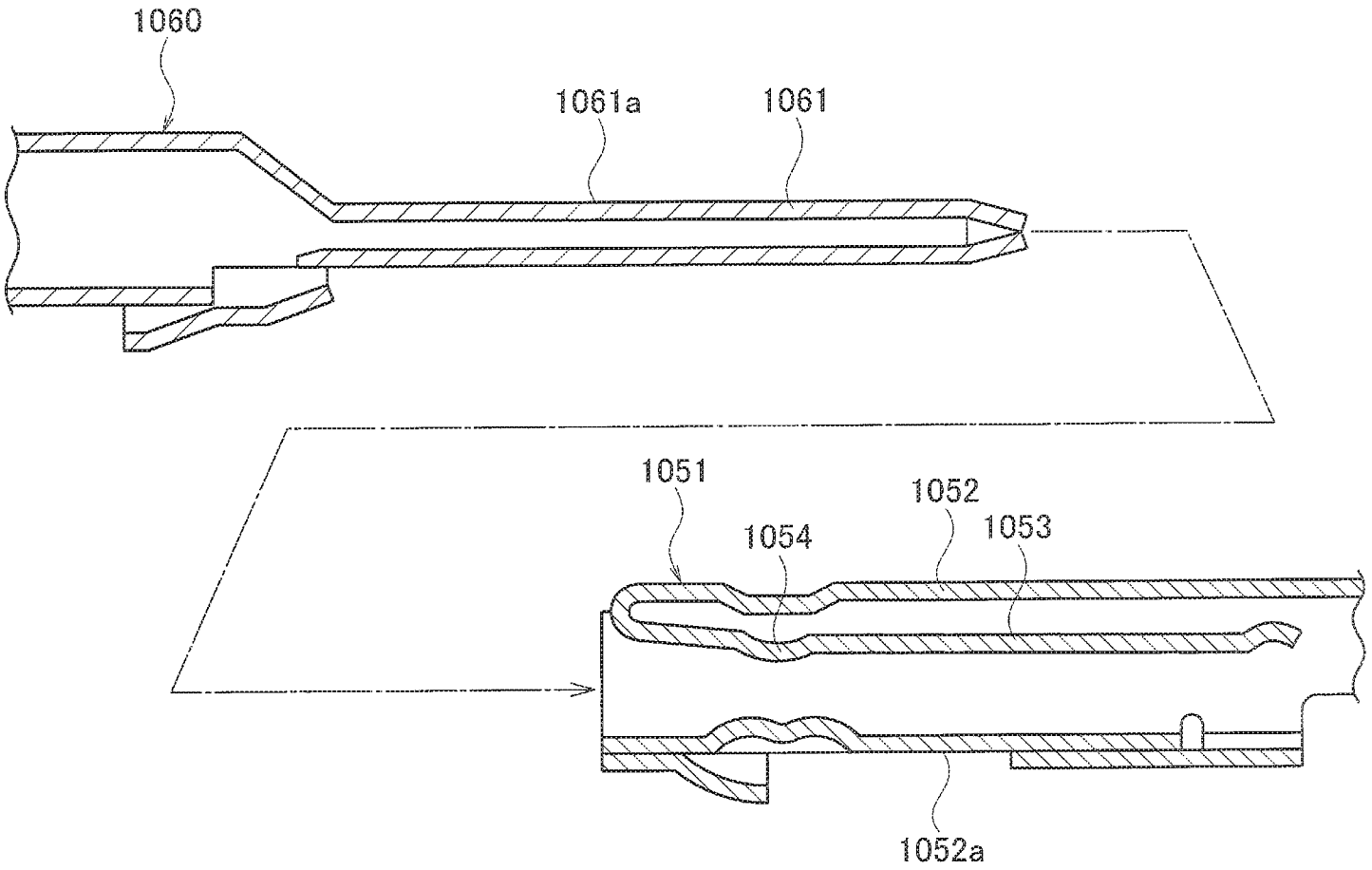
FIG. 29 shows a conventional example and is a sectional diagram of the female terminal and the male terminal before terminal connection.
Figure 30:
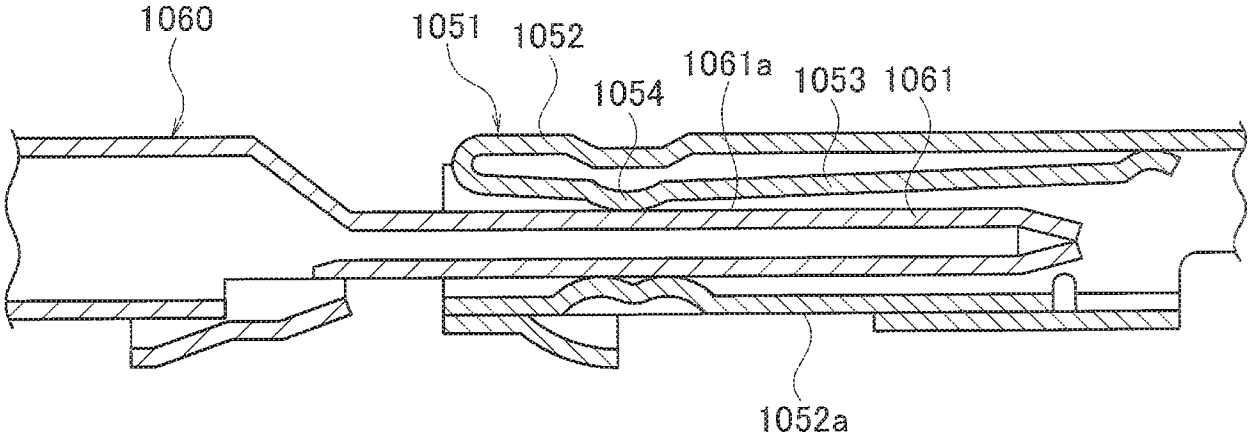
FIG. 30 shows the conventional example and is a sectional diagram of the female terminal and the male terminal in a connected state of the terminals.
Figure 31A:
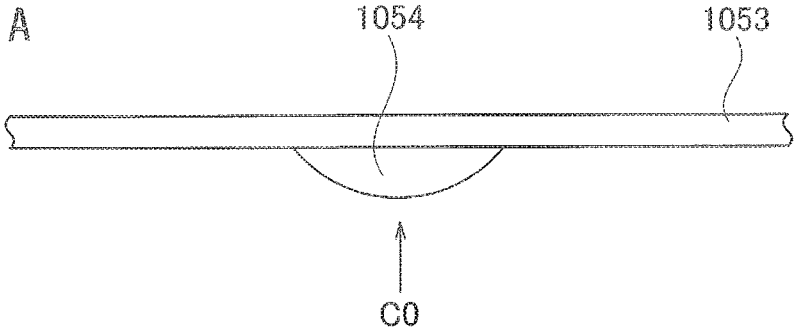
FIG. 31A shows the conventional example, and is an essential part side view of the contact part of the female terminal.
Figure 31B:
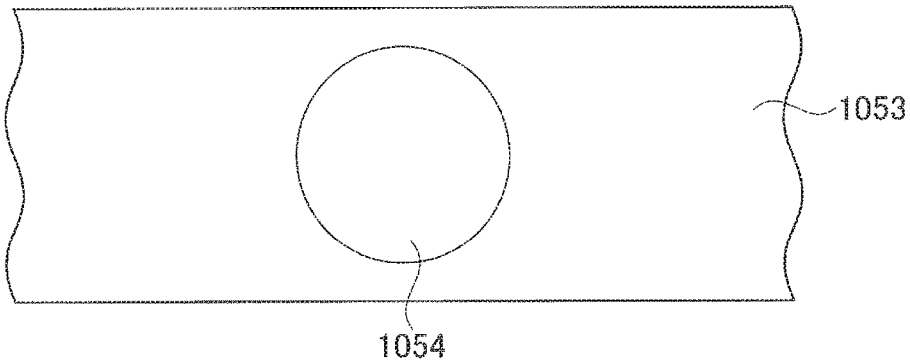
FIG. 31B shows the conventional example, and is a C0 arrow view of FIG. 31A.
Figure 32A:
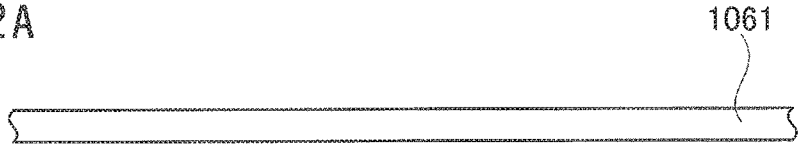
FIG. 32A shows the conventional example, and is an essential part side view of the contact part of the male terminal.
Figure 32B:
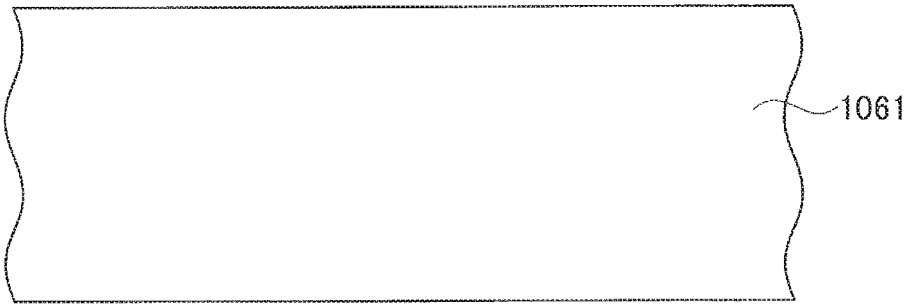
FIG. 32B shows the conventional example, and is an essential part plan view of the contact part of the male terminal.
Figure 33:
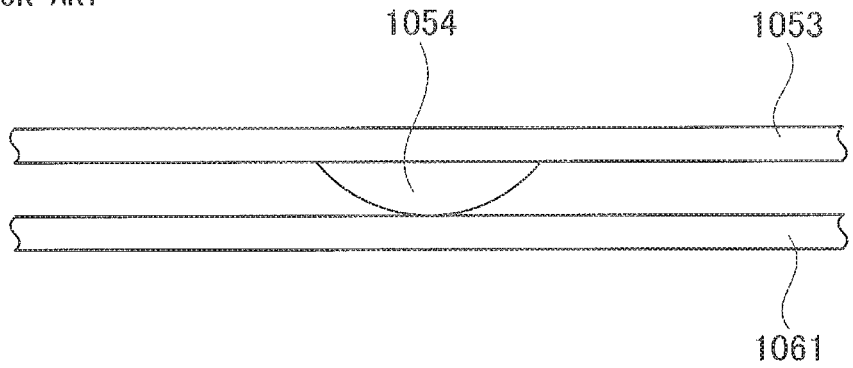
FIG. 33 PRIOR ART
FIG. 33 shows the conventional example and is an essential part side view of a contact connection spot.
Figure 34:
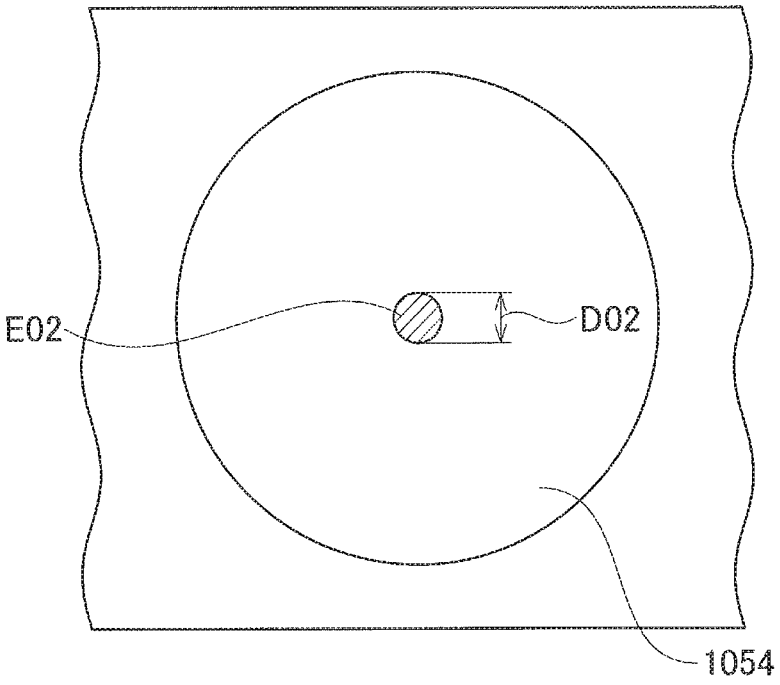
FIG. 34 PRIOR ART
FIG. 34 is a diagram showing the apparent contact surface diameter of the conventional example.
Figure 35A:
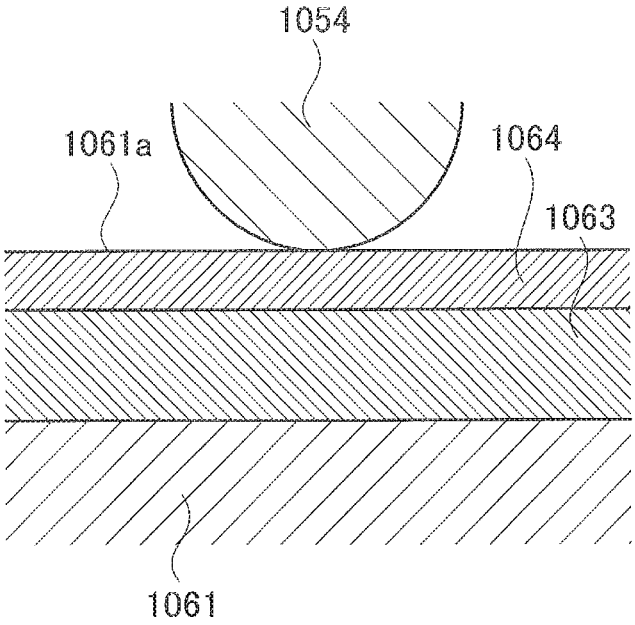
FIG. 35A PRIOR ART
FIG. 35A shows the conventional example, and is a diagram showing a state before destruction of the oxide film formed on the plated layer.
Figure 35B:
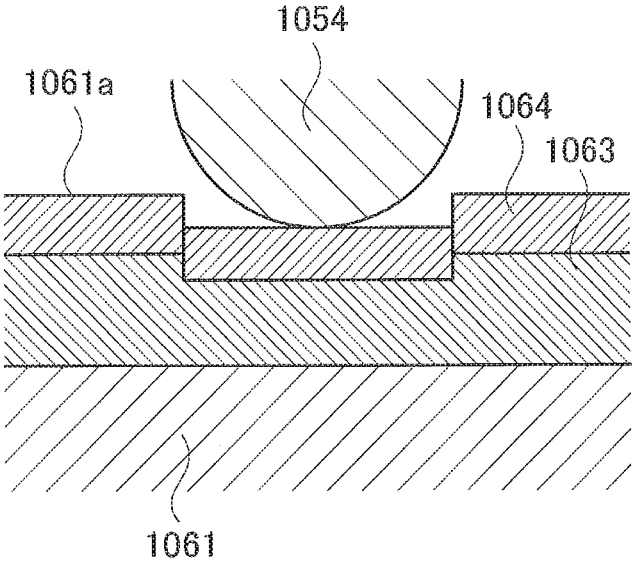
FIG. 35B PRIOR ART
FIG. 35B shows the conventional example, and is a diagram showing a state after destruction of the oxide film formed on the plated layer.

Next, a dimension relation between the indent part 504 and one pair of the projected walls 512 will be described. When assuming that a height of the indent part 504 is H, a height of each projected wall 512 is h as shown in FIG. 28C, H≥h. When assuming that a center-to-center pitch of one pair of the projected walls is P, a radius of the indent part 504 is TR, a radius of each projected wall 512 is Tr, and an angle between a line that connects between a center O1 of the indent part 504 and a center O2 of the projected wall 512 and a vertical line V1, V2 is θ, P=2(TR+Tr)·sin 0.

In the above-mentioned configuration, when fitting is made between the female side connector housing (not shown) and the male side connector housing (not shown), the tab part 511 of the male terminal 510 is inserted into the box part 502 of the female terminal 501 in the fitting process thereof. Then, first, a leading end of the tab part 511 abuts on the elastic deflection part 503, when insertion further advances from this abutment spot, the elastic deflection part 503 deflectively deforms and insertion of the tab part 511 is allowed. In the insertion process (the terminal insertion process) of the tab part 511, the indent part 504 of the elastic deflection part 503 slides on a contact surface of the tab part 511. In addition, one pair of the projected walls 512 slide on the both sides of the outer circumference surface of the indent part 504. At the terminal insertion completion position (the connector fitting completion position), as shown in FIG. 26A to FIG. 26C, the both sides of the outer circumference surface of the indent part 504 come into contact with one pair of the projected walls 512 and the central spot (the top spot) of the outer circumference surface of the indent part 504 comes into contact with a contact surf lice of the tab part 511.

In this contact-connection structure, at the terminal insertion completion position, true contact surfaces S1 are formed at positions corresponding to the both-side positions of the outer circumference surface of the indent part 504 on the female terminal 501 and the mate terminal 510 as shown in FIG. 26D, and a diameter on the circumference on which this true contact surface S1 is arranged can be regarded as an apparent contact surface diameter D51 (shown in FIG. 26D), and therefore the apparent contact surface diameter D51 is large in comparison with a conventional one. Then, the true contact surface S1 is yielded on an outer circumference part of the apparent contact surface diameter D51. In addition, since a true contact surface S2 is yielded also at a position corresponding to the central spot (the top spot) of the outer circumference surface of the indent part 504, the true contact surfaces S1 and S2 are yielded more than conventional ones. The apparent contact surface diameter D51 is large and many true contact surfaces S1 and S2 are yielded in this way. In particular, the true contact surface S1 is yielded surely on the outer circumference part of the apparent contact surface diameter D51 through which the electric current is easy to flow. From the above, the contact resistance can be reduced without upsizing and complicating to the utmost the terminals.

When assuming that the height of the indent part 504 is H, the height of each projected wall 512 is h, the center-to-center pitch of one pair of the projected walls 512 is P, the radius of the indent part 504 is TR, the radius of each projected wall 512 is Tr, and the angle between the line that connects between the center O1 of the indent part 504 and the center O2 of the projected wall 512 and the vertical line V1, V2 is θ, they are set such that H≥h, P=2(TR+Tr)·sin θ. Accordingly, as shown in FIG. 26B, FIG. 26C, and FIG. 28C, since the both sides of the outer circumference surface of the indent part 504 surely come into contact with one pair of the projected walls 512, and the central spot (the top spot) of the outer circumference surface of the indent part 504 surely comes into contact with the contact surface of the tab part 511 respectively, the apparent contact surface diameter D51 becomes surely large in comparison with the conventional one and the true contact surfaces S1 and S2 are surely yielded more than the conventional ones.

One pair of the projected walls 512 are arranged at interval in the direction orthogonal to the sliding (insertion) direction of the indent part 504, it slides such that the central spot of the indent part 504 intrudes into between one pair of the projected walls 512 and reaches the terminal insertion completion position. Accordingly, since the indent part 504 (a first indent part) can slide without running on the projected walls 512 (a second indent part) to the utmost in the terminal insertion process or the terminal detachment process, the terminal insertion force and the terminal detachment force can be prevented from becoming large to the utmost.

In the present embodiment, although each indent part 504 is spherical in shape of the outer circumference surface, the shape of the outer circumference surface of each indent part 504 is not limited thereto. It may be a curved surface shape that the top is set at the highest position and it becomes gradually low along a smooth curved surface as it goes toward the outer circumference, an oval spherical surface, a conical shape, a pyramid shape.

The above-described first to seventh embodiments are mere exemplifications that have been described in order to facilitate understanding of the present invention and the present invention is not limited to the embodiments concerned. The technical range of the present invention is not limited to the specific technical matters disclosed in the above-mentioned embodiments and includes various modifications, alterations, alternative technologies and so forth that would be derived from them with ease.

INDUSTRIAL APPLICABILITY

According to the present invention, since the first contact part and the second contact part come into contact with each other on the three or more contact surfaces situated on the same circumference and the diameter on the circumference on which these three or more contact surfaces have been arranged can be regarded as the apparent contact surface diameter, the apparent contact surface diameter is large in comparison with that of the conventional example, and the true contact surfaces are yielded on the outer circumference spot of the apparent contact surface diameter. Since the electric current that flows through the contact parts does not averagely flow relative to the apparent contact surface diameter and is easy to flow to the outer circumference part of the contact surface diameter, and therefore it flows efficiently. From the above, the contact resistance can be reduced without upsizing and complicating to the utmost the terminals.

REFERENCE SIGNS LIST

1, 101, 201, 301, 401, 501, 1051 female terminal (first terminal)

2, 102, 202, 303, 402, 502, 1052 box part

2*a*, 102*a*, 202*a*, 305*b*, 306*c*, 402*a*, 502*a* bottom surface part (first contact part)

3, 103, 203, 305*a*, 403, 503, 1053 elastic deflection part (first contact part)

4, 12, 104, 204, 307, 404, 504, 1054 first indent part

10, 110, 211, 302, 410, 510, 1060 male terminal (second terminal)

11, 111, 212, 304, 411, 511, 1061 tab part (second contact part)

12 second indent part

The invention claimed is:

1. A contact-connection structure comprising:

a first contact part of a first terminal in which three or more first indent parts are projectingly provided on a same circumference of an imaginary circle, the three or more indent parts projecting downwardly in a direction orthogonal to an insertion direction; and a second contact part of a second terminal insertable with the first contact part in the insertion direction, in which one second indent part is projectingly provided, the one second indent part projecting upwardly in a direction orthogonal to the insertion direction, wherein in a terminal insertion process of inserting the second contact part with the first contact part, each of the first indent parts of the first contact part slides on the second contact part and the second indent part of the second contact part slides on the first contact part, and at a terminal insertion completion position, the second indent part intrudes into a position surrounded by the three or more first indent parts, and outer circumference surfaces of the first indent parts come into contact with an outer circumference surface of the second indent part, respectively, at three or more respective contact surfaces;

wherein an apparent contact surface diameter is defined by the three or more respective contact surfaces arranged on the outer circumference of the surface of the second indent part, and the apparent contact surface diameter is set by setting the positions of the three or more first indent parts provided on the same circumference to reduce a contact resistance between the first contact part and the second contact part; and wherein an outer diameter of the second indent part is larger than an outer diameter of each of the first indent parts.

2. The contact-connection structure according to claim 1, wherein at least two of the three or more first indent parts is arranged at a position deviated from a sliding track of the second indent part.

3. The contact-connection structure according to claim 1, wherein the apparent contact surface diameter is set by setting the positions of the three or more first indent parts provided on the same circumference to reduce a contact resistance between the first contact part and the second contact part according to a relation:

$$R=(\rho/D)+(\rho/2na)$$

where, R is the contact resistance, ρ is a resistivity of a material of the first and second contact parts, D is the apparent contact surface diameter, n is a number of the three or more respective contact surfaces and a is a radius of the of the three or more respective contact surfaces.

4. The contact-connection structure according to claim 1, wherein the first contact part and the second contact part comprise plated layers.

* * * * *